US011690433B2

(12) United States Patent
Alicea-García

(10) Patent No.: US 11,690,433 B2
(45) Date of Patent: Jul. 4, 2023

(54) TOOL FOR REMOVING NAIL POLISH AND BUFFING NAILS

(71) Applicant: Johanna Alicea-García, San Juan, PR (US)

(72) Inventor: Johanna Alicea-García, San Juan, PR (US)

( * ) Notice: Subject to any disclaimer, the term of this patent is extended or adjusted under 35 U.S.C. 154(b) by 887 days.

(21) Appl. No.: 16/282,228

(22) Filed: Feb. 21, 2019

(65) Prior Publication Data

US 2019/0254404 A1 Aug. 22, 2019

Related U.S. Application Data

(60) Provisional application No. 62/633,524, filed on Feb. 21, 2018.

(51) Int. Cl.

| | |
|---|---|
| ***A45D 29/12*** | (2006.01) |
| ***A45D 29/00*** | (2006.01) |
| ***A45D 29/17*** | (2006.01) |

(52) U.S. Cl.

CPC ..... *A45D 29/007* (2013.01); *A45D 29/12* (2013.01); *A45D 29/17* (2013.01); *A45D 2200/1018* (2013.01)

(58) Field of Classification Search

CPC ..... A45D 29/00; A45D 29/007; A45D 29/04; A45D 29/05; A45D 29/11; A45D 29/12; (Continued)

(56) References Cited

U.S. PATENT DOCUMENTS 743,685 A 11/1903 Broadhurst
893,004 A 7/1908 Miller
(Continued)

*Primary Examiner* — Cris L. Rodriguez
*Assistant Examiner* — Karim Asqiriba
(74) *Attorney, Agent, or Firm* — Hector M. Reyes Rivera

(57) ABSTRACT

A nail care tool having an ergonomic elongated handle and a removable operational head attached to the handle is presented. The tool also has a removable scraper or end tip inserted in one of the ends of the handle, useful in cleaning critical cuticle areas. The operational head has adhered to it a lining of material commonly used in the nail care and maintenance processes; for instance, it may be a nail polish removal material or a nail buffing material. In some embodiments of the invention, the ergonomic handle and the head are interconnected in a nonpermanent manner by a male/female system; in such embodiments, the head may be engage or connected to the handle by screwing the head to the handle and, it may be disengaged or disconnected, by simply unscrewing it from the handle. In other embodiments of the invention, the handle is connected to the head by a hold/release system, allowing the User to connect the head and the handle by inserting an already assembled cartridge inside the handle into a rectangular internal cavity on the head. In order to disconnect the head from the handle, the User slides backwardly a button on the ergonomic handle without even having to touch the head. The hold/release system allows the User to easily attach or detach heads to the handle. The operational removable head required for any of the embodiments may have different shapes and operational lining materials, in order for the User to use the tool as an applicator—meaning being able to remove most of the nail polishes—or as a nail buffer.

14 Claims, 20 Drawing Sheets

(58) Field of Classification Search
CPC ..... A45D 29/14; A45D 29/17; A45D 29/18; A45D 20/20; A45D 2200/1018; A45D 31/00
See application file for complete search history.

(56) References Cited

U.S. PATENT DOCUMENTS

| | | | |
|---|---|---|---|
| 1,007,816 | A | 11/1911 | Stubenrauch |
| 1,667,570 | A | 4/1928 | Thelander |
| D92,088 | S | 4/1934 | Johnson |
| D137,554 | S | 3/1944 | Herb |
| 2,442,051 | A | 5/1948 | Luscri |
| 2,713,693 | A | 7/1955 | E. Johnson |
| 2,804,636 | A | 9/1957 | Sadler |
| 2,841,809 | A | 7/1958 | Oliver |
| 3,179,327 | A | 4/1965 | Burton et al. |
| D202,874 | S | 11/1965 | Luedtkd et al. |
| 3,317,944 | A | 5/1967 | Napier, Sr. et al. |
| 3,324,855 | A | 6/1967 | Heimlich |
| 3,369,267 | A | 2/1968 | Friedland et al. |
| 3,369,553 | A | 2/1968 | Keesee |
| 3,519,364 | A | 7/1970 | Thuhan |
| 3,759,259 | A | 9/1973 | Truhan |
| 3,759,375 | A | 9/1973 | Nappi |
| 3,891,331 | A | 6/1975 | Avery |
| 4,148,318 | A | 4/1979 | Meyer |
| 4,366,828 | A | 1/1983 | Hokama |
| 4,483,356 | A | 11/1984 | Kales |
| 4,627,758 | A | 12/1986 | Winthrop |
| 4,701,168 | A | 10/1987 | Gammons |
| 4,884,913 | A | 12/1989 | Smith et al. |
| 4,893,956 | A | 1/1990 | Wojcik et al. |
| 4,998,839 | A | 3/1991 | Bashir |
| D329,718 | S | 9/1992 | Sulik |
| D369,438 | S | 4/1996 | Resler |
| 5,642,913 | A | 7/1997 | Brown |
| 5,855,212 | A | 1/1999 | Walker |
| 5,899,210 | A | 5/1999 | Letherby et al. |
| 6,035,859 | A | 3/2000 | Antonopoulos-Mclvor |
| 6,102,048 | A | 8/2000 | Baker |
| 6,405,735 | B1 | 6/2002 | Dockery |
| 6,786,667 | B1 | 9/2004 | Thomas et al. |
| 7,127,768 | B2 | 10/2006 | Blum et al. |
| 7,159,265 | B2 | 1/2007 | Soller et al. |
| 7,458,381 | B2 | 12/2008 | Shepard |
| D666,772 | S | 9/2012 | Park |
| 9,113,691 | B1 | 8/2015 | Picazo et al. |
| 2005/0081870 | A1 | 4/2005 | Jancik |
| 2008/0115302 | A1 | 5/2008 | Kilkenny et al. |
| 2008/0142405 | A1 | 6/2008 | Knapp |
| 2009/0090376 | A1 | 4/2009 | Wang |
| 2009/0152132 | A1 | 6/2009 | Wang |
| 2010/0083976 | A1* | 4/2010 | Montana-Selers ... A45D 34/042 132/73 |
| 2011/0116857 | A1* | 5/2011 | Carroll ..... A45D 34/04 401/101 |
| 2014/0133895 | A1* | 5/2014 | Dockery ..... A45D 29/007 401/196 |
| 2014/0182073 | A1 | 7/2014 | Mitchel |
| 2015/0144150 | A1* | 5/2015 | Toeg ..... A61L 2/18 132/74.5 |
| 2015/0150353 | A1* | 6/2015 | Yiu ..... A61B 17/54 132/75.6 |
| 2016/0302549 | A1* | 10/2016 | Lee ..... A45D 29/18 |

* cited by examiner

FIG. 6A
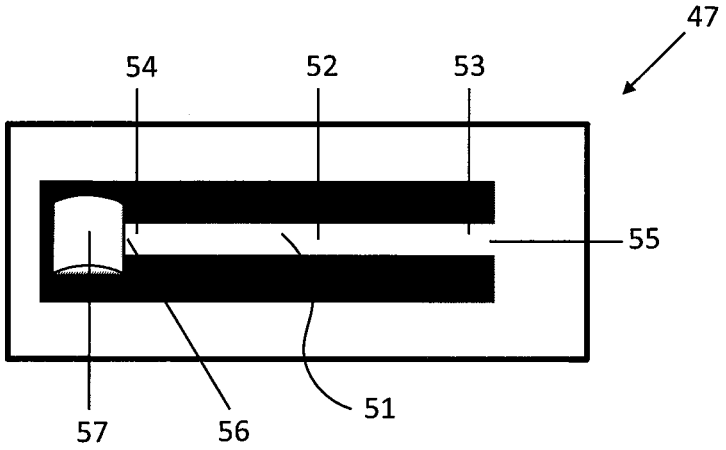
FIG. 6B
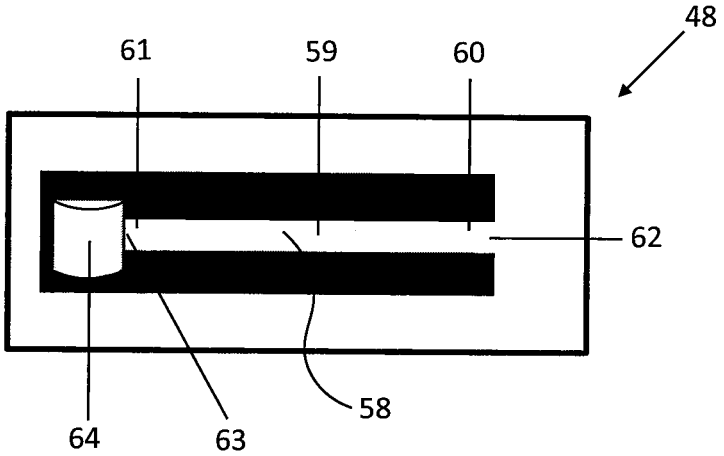
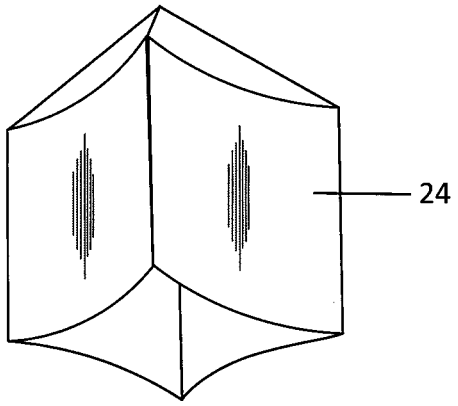
FIG. 7

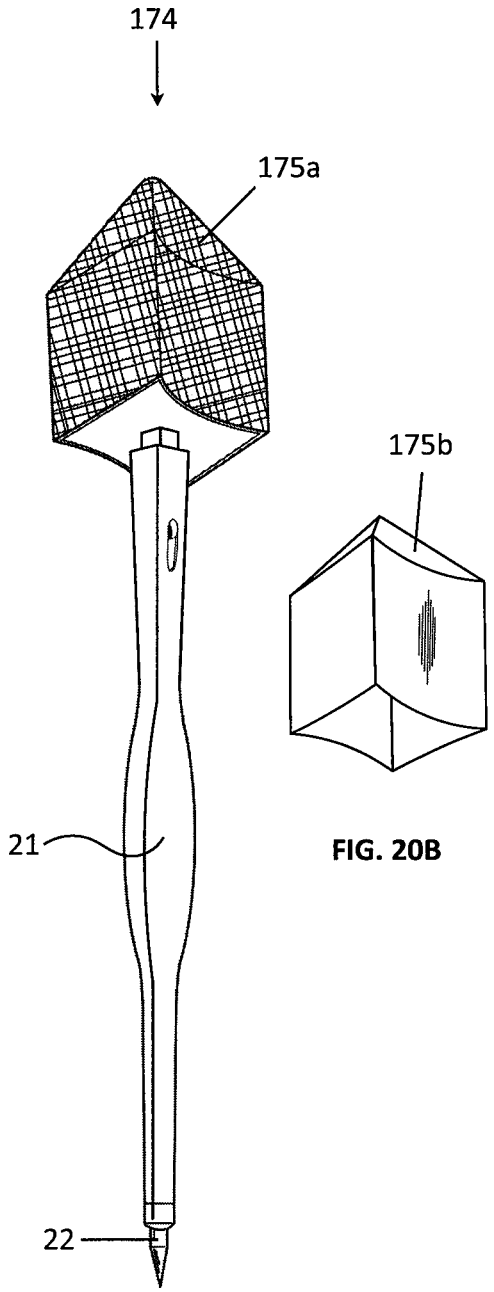
FIG. 20A
FIG. 20B
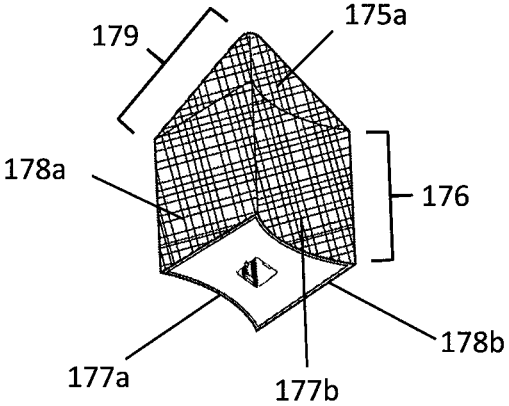
FIG. 21A
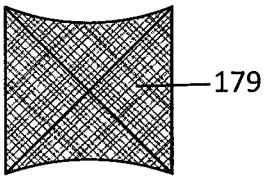
FIG. 21B

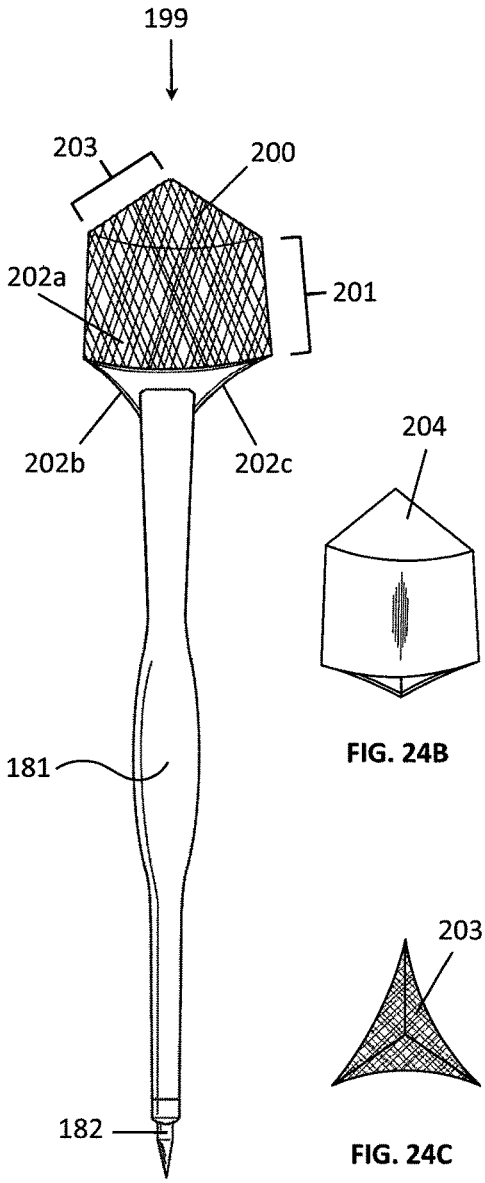
FIG. 24A
FIG. 24B
FIG. 24C
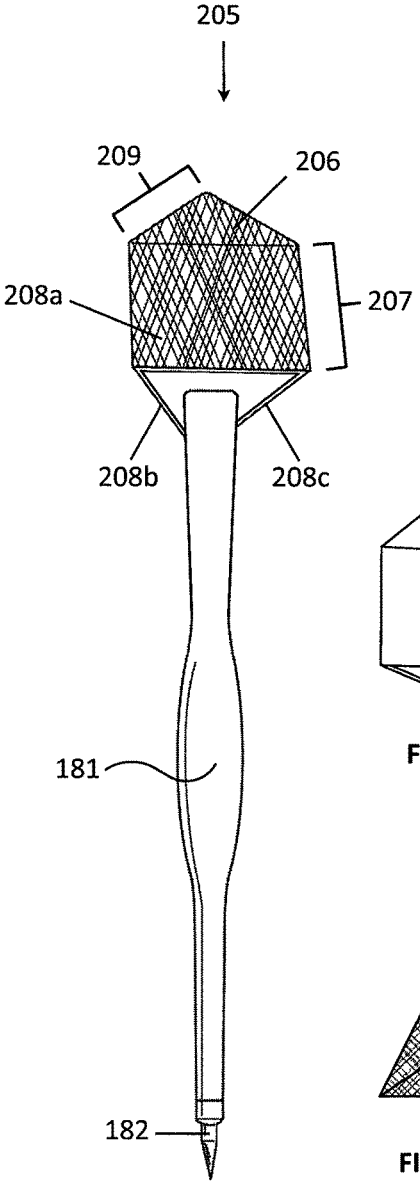
FIG. 25A
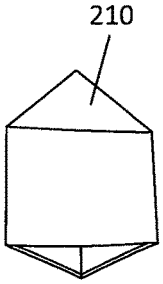
FIG. 25B
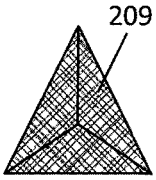
FIG. 25C

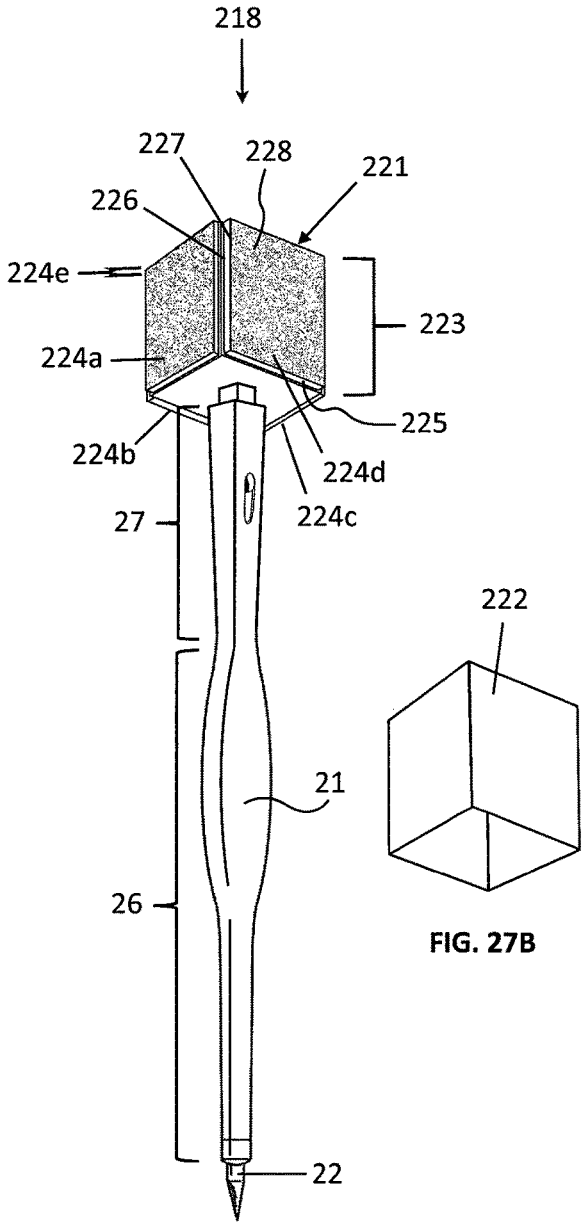
FIG. 27B
FIG. 27A
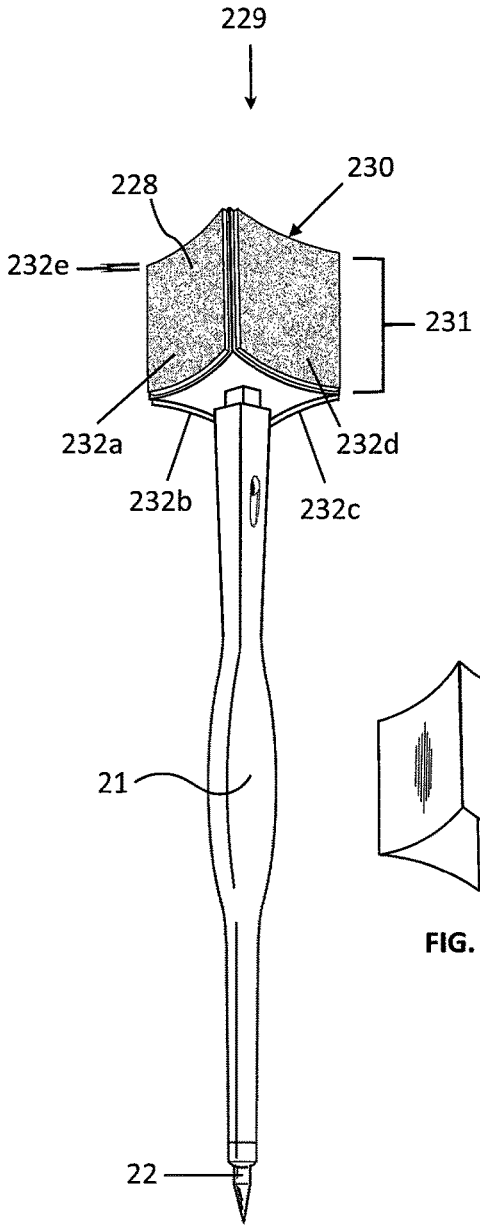
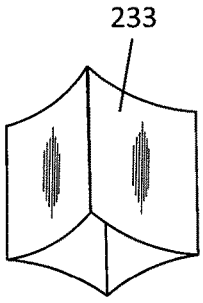
FIG. 28B
FIG. 28A

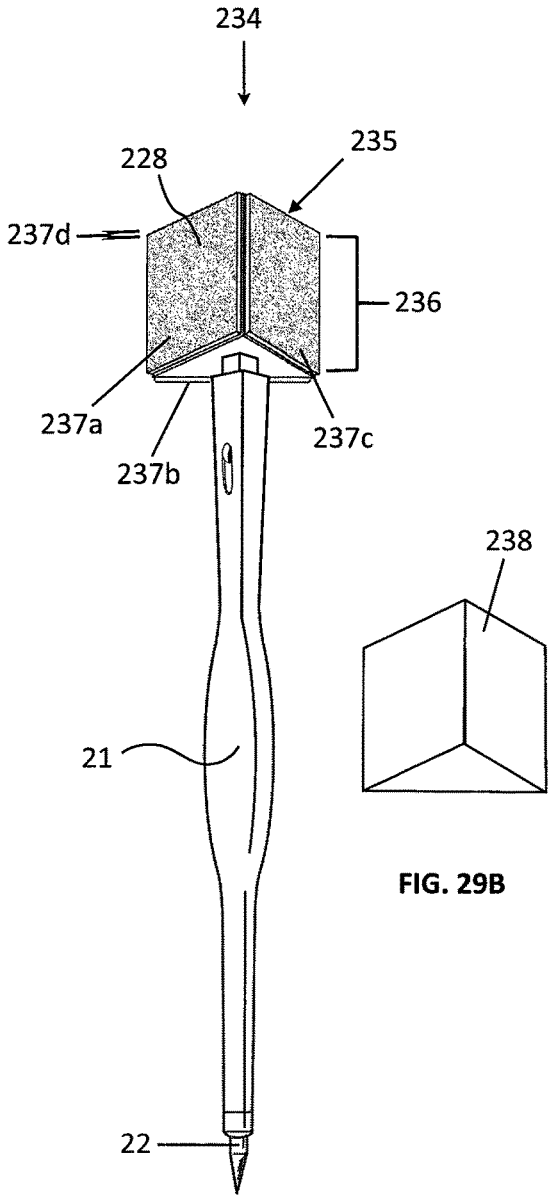
FIG. 29B
FIG. 29A
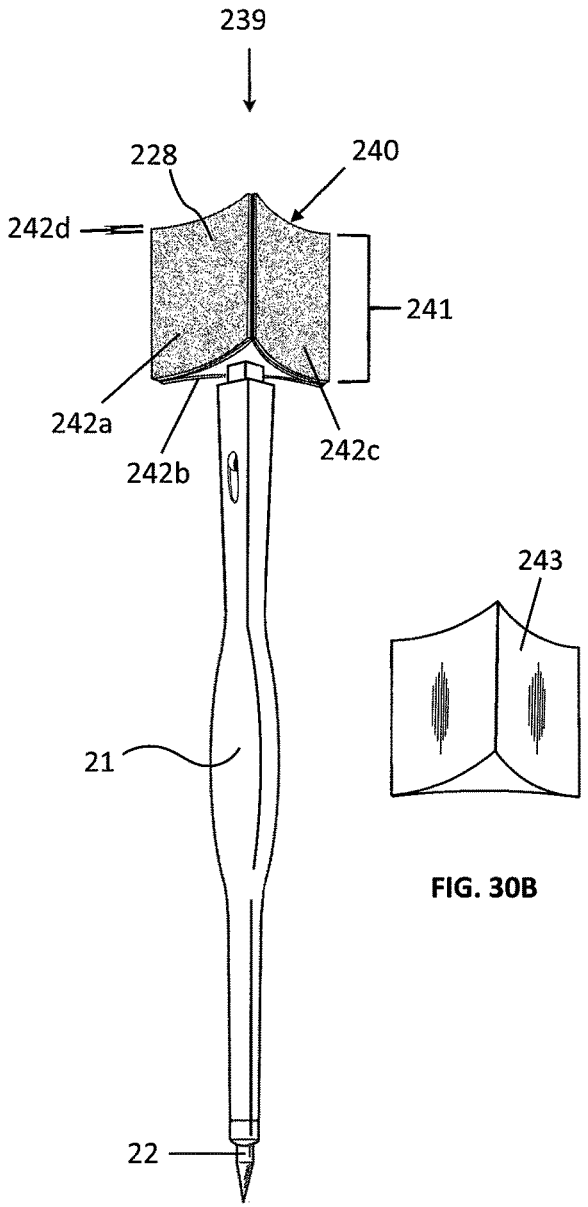
FIG. 30B
FIG. 30A

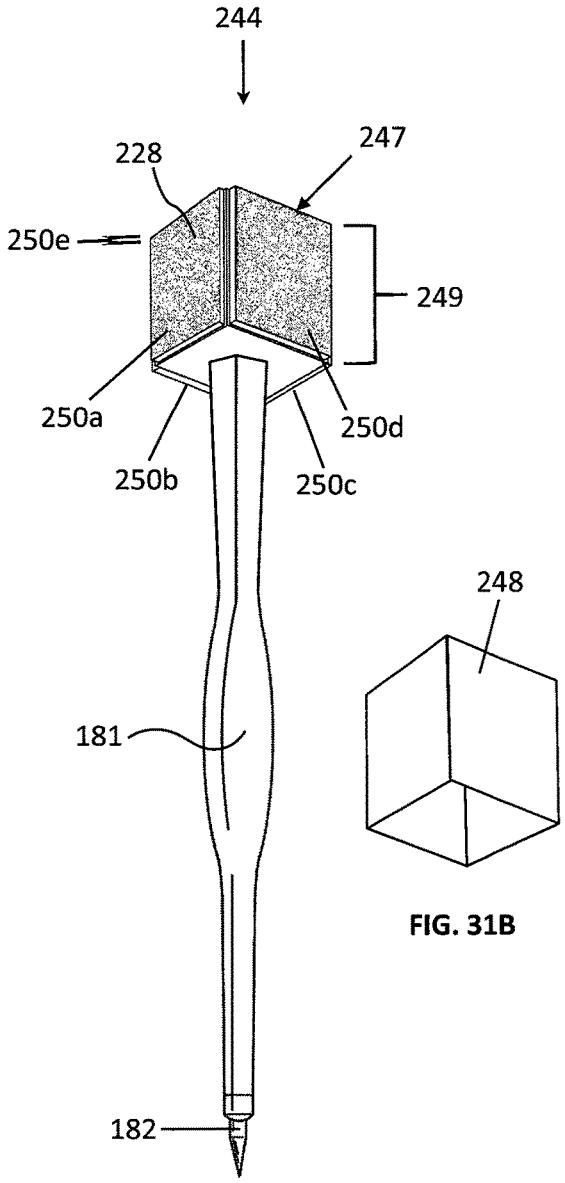
FIG. 31B
FIG. 31A
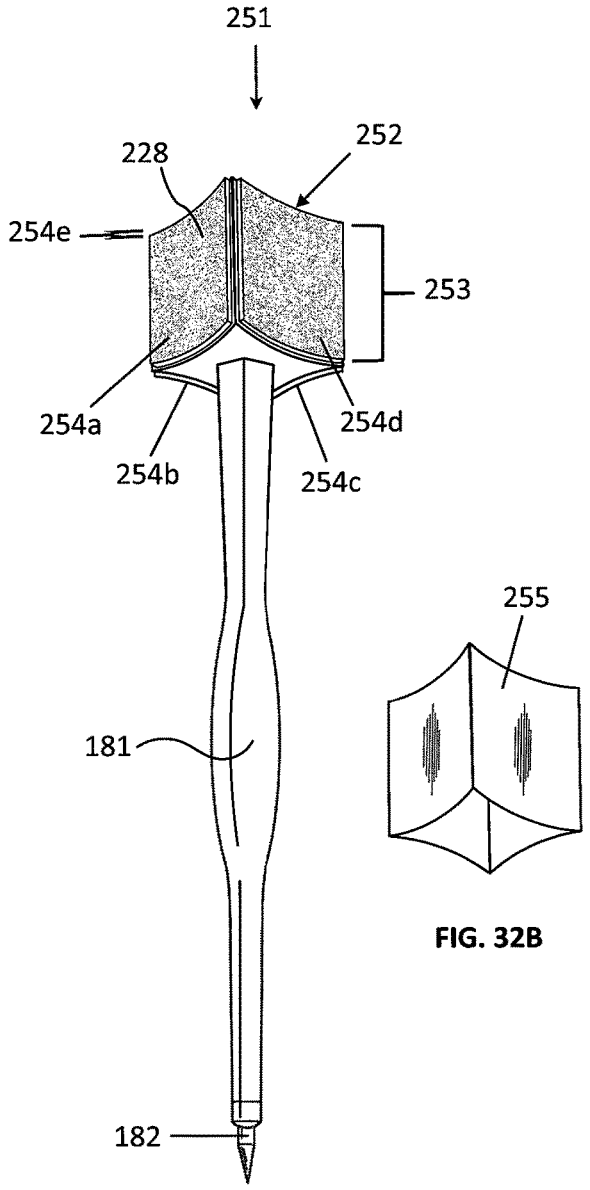
FIG. 32B
FIG. 32A

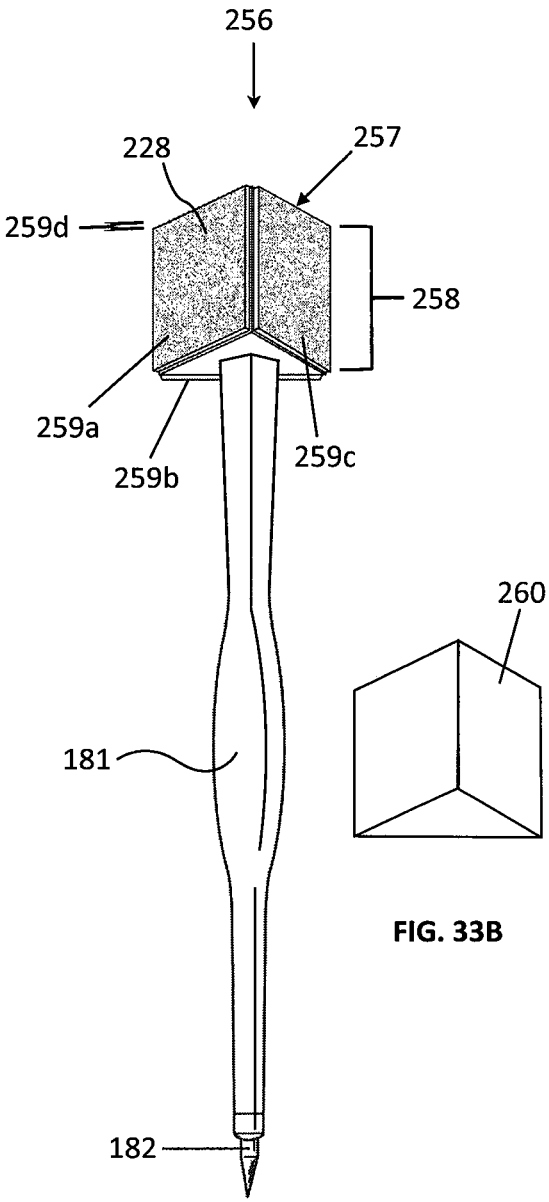
FIG. 33B
FIG. 33A
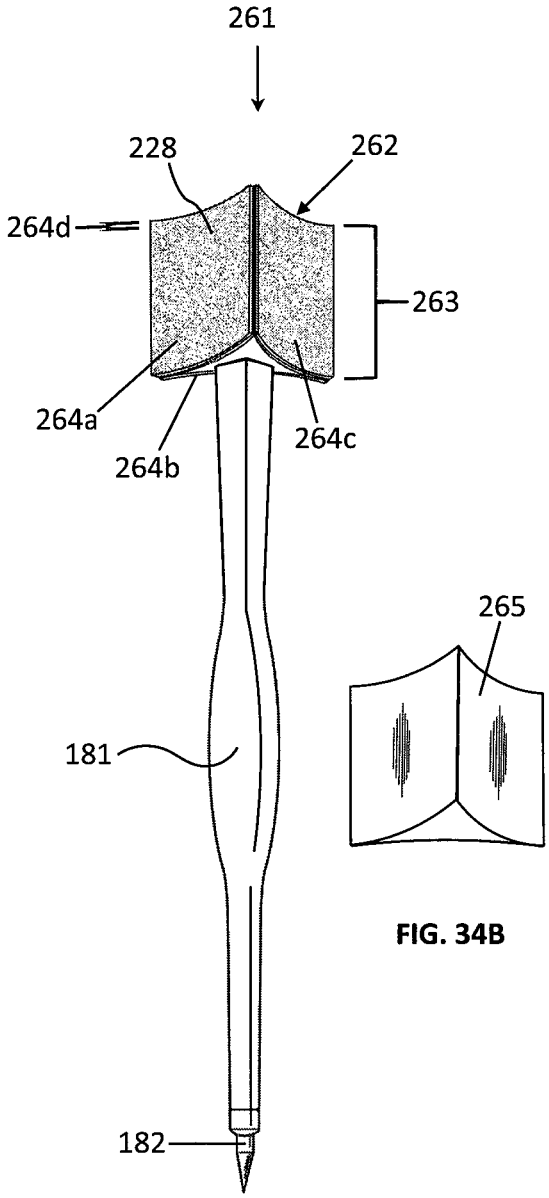
FIG. 34B
FIG. 34A

TOOL FOR REMOVING NAIL POLISH AND BUFFING NAILS

CROSS REFERENCE TO RELATED APPLICATIONS

This application claims the benefit of U.S. Provisional Application No. 62/633,524, filed on Feb. 21, 2018 and claim the benefit of its earlier date under 35 USC section 119 (e).

TECHNICAL FIELD

This invention relates to nail care devices and systems. More specifically, it relates to a nail care tool comprising an ergonomic handle, a replaceable head and an end tip, that allows a person to conveniently remove nail polish, buff nails and clean nails and surrounding nail areas.

BACKGROUND

Nail care is an essential part in the maintenance of personal hygiene. In order to maintain healthy nails, individuals must keep their fingernails and toenails well groomed at all times. The common practices of enhancing the appearance of nails comprise removing old or damaged nail polish and buffing.

Modern nail polish has been on the nail care market for almost 100 years. Many individuals today, mostly women, beautify their fingernails and toenails by applying nail polish themselves or going to a professional nail technician to have them done. With an array of different nail polish types, colors and finishes to choose from, there seems to be no limit to how a person wears their nails. Nail lacquer, also known as regular nail polish, and no lamp long-lasting polishes are among the most commonly used nail polishes. Regular nail polish basically consists of film-forming agents, resins, solvents and pigments. No lamp long-lasting polishes provide users a hybrid of nail lacquer and gel.

A pristine nail manicure or pedicure can be achieved with a correct application of thin, even layers of base coat, nail polish and topcoat. However, even if the nail polish is applied with the proper procedure, most people constantly change it, completely or selectively, mainly due to chipping or smudging of the polish, grow out or an outfit change. This removal always involves cleaning off the existing polish by applying commercially available solvents in the form of nail polish removers.

When it comes to removing regular nail polish, no lamp long-lasting polishes or the like, the process usually becomes laborious, quite messy and time consuming, principally when removing darker and glitter-based polishes. Current commonly used methods employed to perform this removal task typically comprise applying nail polish remover onto a polished nail, with the use of a cotton ball, cotton round, nail polish remover pad or wipe, sponge, tissue or similar tool. Some of these tools need to be initially soaked in nail polish remover solution, and some already come pre-soaked with the fluid. In either case, the subsequent steps of holding the sodden tool with the fingers of one hand and rubbing it over the surface of a nail in the other hand in order to remove the nail polish therefrom, will inevitably and undesirably expose the user's fingers and fingernails to come into contact with a potentially hazardous enamel solvent and to get stained with dissolved polish. This occurs especially when the user desires to remove the polish entirely from all their nails, since this ordinarily requires rubbing repeatedly with the use of many units of the tool. If the person only wants to fix a damaged nail, it is almost inevitable that previously applied nail polish on their fingernails will end up smudged, marred or removed. Likewise, when a person uses their hands to remove old polish from their toenails, which for many are difficult to reach, their fingernails with previously applied nail polish are usually damaged.

The enamel solvent exposure problem is greatly compounded for many professional nail technicians that use those conventional tools daily, mostly cotton balls, to remove nail polish from their client's nails, often many times per day. While performing the removal, these nail techs commonly hold the saturated tool with their bare fingers. Thus, among the day-to-day challenges that numerous nail technicians confront, due to solvent exposure through skin or fingernail contact, is taking care of the appearance of their own fingernails when applying polish remover to others. It is also a challenge to reduce coming into contact with hazardous chemicals found in numerous polish removers, such as Acetone, Butyl Acetate and Ethyl Acetate, which can have health effects, including skin disorders. In this respect, contact dermatitis, also known as eczema, is the most common skin disorder encountered by nail technicians. Although wearing disposable gloves could minimize such exposure, doing so limits manual dexterity and might get very uncomfortable. At the same time, wearing them frequently and repeatedly may cause red, dry, itchy, irritated areas or blisters on the hands and wrists.

Further, those above-mentioned soft and bendable tools are not capable of holding a firm shape when in use, thus complicating the removal of polish from the nail edges and alongside the cuticle area. It also provokes the generation of irregular friction during cleaning mainly due to the shape variation in the area of contact of the tool when pressed over the nail surface, which is normally curved transversely. Less uniform friction forces between the soaked tool and the nail surface means it is harder to remove the polish.

In addition to those conventional tools, other types of nail polish removing devices have been proposed over the years. Various devices exist for removing nail polish comprising a handle portion in combination with an absorbent material component. Illustrative of this approach are disclosed in the following patent documents: Luscri U.S. Pat. No. 2,442,051 (May 1948); Johnson U.S. Pat. No. 2,713,693 (July 1955); Oliver U.S. Pat. No. 2,841,809 (July 1958); Winthrop U.S. Pat. No. 4,627,758 (December 1986); Smith et al. U.S. Pat. No. 4,884,913 (December 1989); Antonopoulos-McIvor U.S. Pat. No. 6,035,859 (March 2000); Dockery U.S. Pat. No. 6,405,735 B1 (June 2002); Crosby U.S. Pat. No. 6,575,172 B1 (June 2003); Thomas et al. U.S. Pat. No. 6,786,667 B1 (September 2004); Knapp et al. Pub. No. US 2008/0142405 A1 (June 2008); Wang Pub. No. US 2009/0090376 A1 (April 2009) and Dockery Pub. No. US 2014/0133895 A1 (Nay 2014).

Dipping jar-based systems is another general category of existing means to remove nail polish. The jar typically contains a sponge-like filler heavily soaked in nail polish remover. The filler is provided with a centered vertical opening into which the finger is inserted. Upon insertion of the fingertip into the aperture of the filler, the person must repeatedly twist and turn the polished nail against the filler until all the polish has been removed. For many people, this system requires skilled manual dexterity and is impractical to remove toenail polish. Because the fingertip is inserted inside the filler during cleaning, the person can not see the nail when the polish is been removed. It usually takes extra effort to remove nail polish completely from the nail edges and alongside the cuticle area. Worse still, in the removal process, the finger is undesirably soaked in a mixture of potentially hazardous solvent and dissolved nail polish. Descriptive of this system are disclosed in the following patent documents: Scherer U.S. Pat. No. 4,440,181 (April 1984); Montiel U.S. Pat. No. 4,446,965 (May 1984); Montiel U.S. Pat. No. 4,530,726 (July 1985); Spector U.S. Pat. No. 4,671,306 (June 1987) and Barclay U.S. Pat. No. 7,225,814 B2 (June 2007).

In addition, U.S. Pat. No. 8,584,683 B2 (November 2013), issued in the name of Shammami, describes a disposable nail polish removing device whose body shape is generally spherical with one or more indentations. These indentations can be used to grasp the device while the remaining surface of the device can be used for nail cleaning purposes. The body of this apparatus is made solely of an absorbent material that compresses during use and resiliently returns to its original shape. This device does not have a handle component. As with the aforementioned traditional tools, to carry out the removal, the user has to hold the sodden apparatus with the fingers of one hand and rub it over the surface of the polished nail, thus inevitably exposing their fingers to come into contact with enamel solvent and to stain with dissolved polish.

Thus, the nail industry needs an improved nail polish removing device that overcomes the identified limitations and difficulties inherent in using the existing tools. It would be beneficial to provide an easy to grasp nail polish remover tool with a handle that permit a more efficient and safer procedure for individual and professional removal of regular nail polish, no lamp long-lasting polishes or the like, from fingernails and toenails.

On the other hand, nail buffing is an essential technique to help give nails a smooth, polished appearance by removing ridges, roughness, jagged nail edges and surface stains. The technique involves abrading, smoothing and polishing the nail using files or nail buffers of successively finer grit. During the past decades, a variety of abrasive tools have been used by individuals and nail technicians to employ this technique, including flat planar files and nail buffer blocks. Particularly, manual nail buffers include rectangular buffer blocks with various operational surfaces, each having an abrasive material or a polishing material, and at least two opposite ends. Illustrative of this kind of tool are disclosed in the following patent documents: Hokama U.S. Pat. No. 4,366,828 (January 1983); Letherby et al. U.S. Pat. No. 5,899,210 (May 1999) and Jancik Pub. No. US 2005/0081870 A1 (April 2005); Kim Pub. No. US 2006/0054177 A1 (March 2006) and Park U.S. Pat. No. D666,772 S (September 2012).

Although functional, traditional nail buffer blocks do not have a handle component, which constitutes a grip shortcoming or limitation. In order to operate it, the user must grasp the tool from its ends or in areas of the operational surfaces having abrasive material, with the bulky block itself in between their fingers. Thus, making troublesome to hold and manipulate the nail buffer block at angles needed to achieve optimum results. During the buffing process, the user has to reposition frequently the nail buffer block in between their fingers, which may lead to grip discomfort. In addition, the skin of the user's fingers, primordially nail technicians, is susceptible to abrasion caused by coming into contact with the abrasive surfaces of the nail buffer block during periods of extended use.

An attempt to overcome this deficiency in the art is disclosed in the U.S. Pat. No. Des. 369,438 (April 1996), issued in the name of Resler, for a nail file ornamental design. This is the design of the commercially available nail buffer block entitled "Block On! Buffing Sponge Wand" from the brand Flowery. This device was formed with a rectangular, elongated block, made of sponge material that provides for four planar surfaces and two opposite ends. Each planar surface have adhered a treatment surface with an abrasive or buffing material, which is disposed on an intermediate foam layer. The treatment surfaces have different grit and are evenly sized. One of the short sides of all its treatment surfaces coincides in one end of the nail buffer block. The remaining portions of the treatment surfaces extend horizontally within the dimensions of the planar surfaces until they reach about two thirds of the length of the block. The areas of the planar surfaces not covered with the treatment surfaces, on the whole, is the handle portion of the tool, which contains four sharp longitudinal corners. This handle section is located on the opposite end to the one where the short sides of all the treatment surfaces coincide.

While the Resler device does provide a useful buffing tool, its handle section, however, has its limitations. Particularly, it does not have an ergonomic design. The grip is not contoured to the curve of the palm of the hand. This shortcoming results in an uncomfortable fit or grip, reduced grip strength and stability, less stroke power, decreasing productivity and hand fatigue. Accordingly, the nail industry needs a multi-surfaced nail buffing tool with an ergonomic handle that comfortably fit the palm of the hand. It would be advantageous to provide an easy to grasp nail buffing tool with a handle that allows the user to conveniently hold and manipulate the tool for maximum efficiency in abrading, smoothing and polishing fingernails and toenails.

An exhaustive worldwide web search of existing nail care devices and systems did not disclose any patent document that read directly on the claims of the instant invention. Therefore, there is a need for a nail care tool that overcomes the identified limitations and difficulties inherent in using the existing devices, permitting more efficient, safe, precise and tidy procedures for removing nail polish and buffing nails.

INVENTION OBJECTIVES

Therefore, it is a primary object of the present invention to provide a novel nail care tool for removing nail polish and buffing nails, comprising: an ergonomic elongated handle, having a manual hold/release system; a removable head attached to the handle, either an applicator head or a nail buffer head; and a scraping or cleaning end tip.

More particularly, a main object of the present invention is to provide a nail care tool having an ergonomic elongated handle that will prevent the sodden applicator head or the nail buffer head from contacting the fingers been used to hold the tool by the handle during the removal or buffing process. The handle will also give the user greater reach when removing polish from their toenails or buffing them.

It is another object of the present invention to provide a nail care tool comprising a firm applicator head, capable of retaining toughness and shape when in use, and an scraping or cleaning end tip that allows a precise enamel removal from a polished nail with minimal solvent exposure to the skin around the nail. In yet another object of the present invention is to provide a nail care tool comprising a contoured firm applicator head with operational sections shaped to fit or receive a nail's convex surface.

It is another object of the present invention to provide a nail care tool comprising a nail buffer head with an ergonomic elongated handle that allows the user to conveniently hold and manipulate the tool.

Another object of the present invention is to provide a nail care tool with a handle having a manual hold/release system that permit the user to easily attach an applicator head or a nail Additional objects of the present invention reside in the provision of a novel nail care tool simple in form and construction, with an attractive appearance, inexpensive to manufacture and efficient in use.

BRIEF SUMMARY

The present invention fulfills the above and other objects, including those that will become apparent bellow, by providing a novel nail care tool comprising an ergonomic elongated handle, a removable head attached to the handle, and a scraping or cleaning end tip. In some of the embodiments, the head is attached to the handle by means of a male/female system, allowing the User to connect or disconnect the head from the handle by simply screwing or unscrewing it, respectively. In other embodiments of the instant invention, the handle and the head are hold together by means of a hold/release system explained in detail below. In such embodiments, the head may be separated from the handle by sliding backwardly or pulling back a button; and it may connect the head back to the handle by inserting the head on the handle. Such connection or disconnection is easily done by means of the hold/release system, which comprises an already assembled cartridge inserted between internal spaces of the handle and the head, as explained in detail below.

All the embodiments disclosed herein comprise a detachable scraping or cleaning end tip, having a cylindrical elongated main body with a pointed end and a diagonal end. Such ends are useful in cleaning critical cuticle areas and the like.

The herein disclosed head is the main operational section of the tool. It may have different geometrical shapes having the exterior surface covered with a lining operational material, herein defined as a suitable material used normally in the care and maintenance of the nails. In some instances, the said material is a polish removal material while, in other instances, is an abrasive material used in buffing nails. The user may conveniently change the operational head of the tool once it has been already used and replaced by a new head. In embodiments having the male/female holding system, said head change may be done with little direct contact of the User's hands on the head. On the other hand, in embodiments having the hold/release system, the User has no need to have a direct contact with the head.

The above and other objects, novel features, structure, advantages and operation of the present invention will be more readily apparent and become better understood with reference to the following more detailed description of the best mode of carrying out the invention and the appended claims. In the description, reference is made to the accompanying drawings, which form a part thereof, and in which there is shown by way of illustration, and not limitation, preferred embodiments of the invention. These embodiments do not represent the full scope of the invention. Rather, reference should there be made to the claims herein for interpreting the scope of the invention.

BRIEF DESCRIPTION OF THE DRAWINGS

The foregoing and additional features and characteristics of the embodiments of the present invention will become more apparent from the following detailed description considered with reference to the accompanying drawings, which are used herein in a manner of example only, and wherein:

FIG. 6A illustrates the head locking snap located in the internal right side of the internal cavity of the head shown in FIGS. 5A and 5B.

FIG. 6B illustrates the head locking snap located in the internal left side of the internal cavity of the head shown in FIGS. 5A and 5B.

FIG. 7 illustrates the head cap of the head section shown in FIG. 5A, useful to protect the head section once it is not being used.

FIG. 11A illustrates perspective view of the cartridge of said hold/release system; FIG. 11B shows a perspective view of the cartridge illustrated in FIG. 11A, after it has been rotated in a 90 degrees angle; and FIG. 11C is a perspective view of the cartridge illustrated in FIG. 11B, after it has been rotated in a 90 degrees angle.

FIGS. 20A and 20B illustrate perspective views of an embodiment of the invention, which comprises a head section with four lateral sides: two straights and two concave; and its corresponding head cap, respectively.

FIGS. 21A and 21B illustrate a perspective view and a top view, respectively, of the head section of the embodiment of the invention illustrated in FIG. 20A.

FIGS. 24A and 24B illustrate perspective views of an embodiment of the invention comprising a head section with three concave lateral sides and its corresponding head cap, respectively.

FIG. 24C is a top view of the head section of the embodiment shown in FIG. 24A, which comprises a top section with three sides pyramidal shape.

FIGS. 25A and 25B illustrate perspective views of an embodiment of the invention comprising a head section with three straight lateral sides and its corresponding head cap, respectively.

FIG. 25C illustrates a top view of the head section of the embodiment illustrated in FIG. 25A, having a three sides pyramidal shape.

FIGS. 27A and 27B illustrate perspective views of an embodiment of the invention, which comprises a head with four straight lateral sides and a flat top, and its corresponding head cap, respectively.

FIGS. 28A and 28B illustrate perspective views of an embodiment of the invention, comprising a head section with four concave lateral sides and a flat top, and its corresponding head cap, respectively.

FIGS. 29A and 29B illustrate perspective views of an embodiment of the invention, comprising a head section with three straight lateral sides and a flat top, and its corresponding head cap, respectively.

FIGS. 30A and 30B illustrate perspective views of an embodiment of the invention, comprising a head section with three concave lateral sides, and its corresponding head cap, respectively.

FIGS. 31A and 31B illustrate perspective views of an embodiment of the invention, comprising a head section with four straight lateral sides and a flat top, and its corresponding head cap, respectively.

FIGS. 32A and 32B illustrate perspective views of an embodiment of the invention comprising a head section with four concave lateral sides and flat top; and its corresponding head cap, respectively.

FIGS. 33A and 33B illustrate perspective views of an embodiment of the invention comprising a head section with three straight lateral sides and a flat top, and its corresponding head cap, respectively.

FIGS. 34A and 34B illustrate perspective views of an embodiment of the invention comprising a head section with three concave lateral sides and its corresponding head cap, respectively.

in FIG. 35, an embodiment of the invention is shown being used in the removal of nail polish; in FIG. 36, an embodiment of the invention is illustrated in use as a nail buffing tool; and in FIG. 37, is illustrated the used of the scraper tip in cleaning cuticle areas.

DETAILED DESCRIPTION OF THE EMBODIMENTS

Detailed embodiments of the present invention are disclosed herein; however, it is to be understood that the disclosed embodiments are merely exemplary of the invention that may be embodied in various and alternative forms. It is thus to be understood that this invention is not limited to particularly exemplified structures, components, methods or uses, as such may, of course, vary. The drawings are not necessarily to scale; some features may be exaggerated or minimized to show details of particular components. It is also to be understood that the terminology used herein is for the purpose of describing particular embodiments of the invention only and is not intended to limit the scope of the invention in any manner. It must be noted that, as used in this specification and the appended claims, the singular forms "a", "an" and "the" include plural referents unless the content clearly dictates otherwise. Therefore, specific structural and functional details disclosed herein are not to be interpreted as limiting, but merely as a representative basis for the claims and/or as a representative basis for teaching one skilled in the art to variously employ the present invention.

In general terms, a series of embodiments according to the instant invention are herein disclosed. All embodiments comprising a head section, an ergonomic elongated handle, a given system to connect and disconnect the head section from the handle. The head section may have different geometrical shapes and all of said head sections include an operational material fixed on the external surface of the head section. Any embodiments herein described comprising as the operational material a nail polish removal material, are herein named "applicator tool"; while those embodiments having as the operational material an abrasive material, are herein named as "buffing tool". Head caps simulating the external geometry of each described head sections are also disclosed.

Figure 1A:
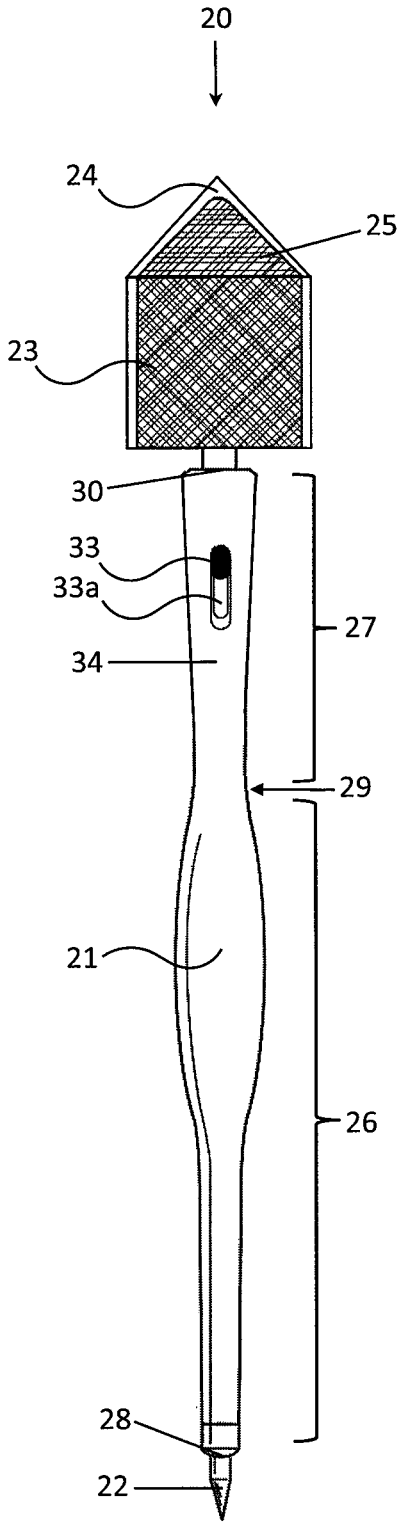
FIG. 1A shows front view of the first embodiment with its corresponding head cap on, according to the instant invention, wherein the different components of the tool are assembled.
Figure 1B:
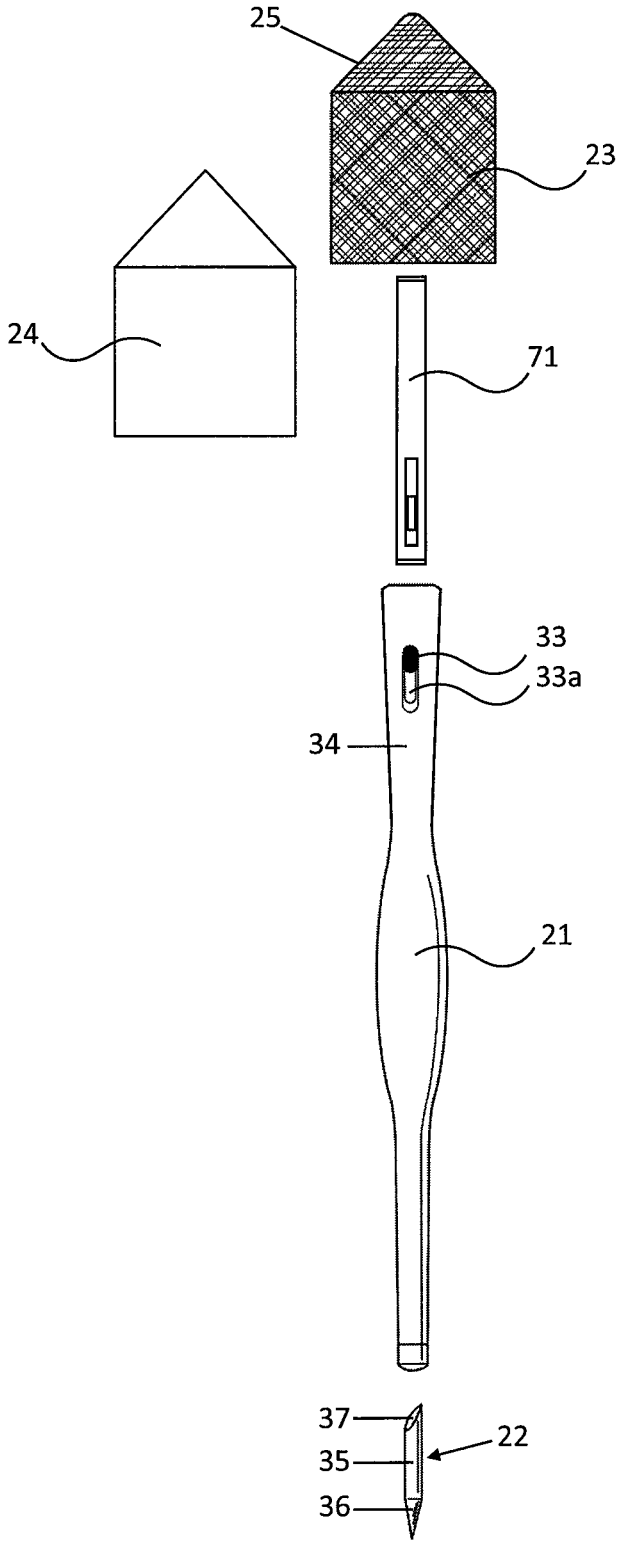
FIG. 1B illustrates the embodiment shown in FIG. 1A, wherein the different components of the tool are separated.

In particular, and in reference to the drawings, FIGS. 1A and 1B illustrate embodiment 20 of the instant invention. FIG. 1A illustrates embodiment 20 already assembled while FIG. 1B shows individual parts of first embodiment 20.

Embodiment 20 comprises an elongated ergonomic handle 21, a scraper 22, a head 23 and a head cap 24. External surface of the head 23 comprises an operational material 25 used in the maintenance of nails. As explained above, the phrase "operational material", as recited in this application, is defined as a material normally used in the maintenance of nails, such as those used in the nail polish removal or nail buffing. The use of a nail polish material as the operational material are called throughout this application as "applicator" or "applicator tool"; while the use of an abrasive material as the operational material are named throughout this application as "buffing" or "buffing tool". Therefore, said operational material defines the particular function of a given embodiment of the tool according to the invention and it may be fixed, secured, attached, or adhered on the external surface of the head section of the tool by means of any suitable and convenient method known in the art, with the intention to cover said external surface of the head section in such a manner that said operational material remains fixed or attached to said external surface. Embodiment 20 illustrates an operational material used in nail polish removal fixed to head 23, thus it represents an applicator tool.

Embodiment 20 also comprises a system that enables the holding or releasing of the head 23 at the will of the User, without the need to touch said head 23. The ergonomic design of the handle 21 provides a suitable shape where the User may place and accommodate its hand and fingers, thus allowing the relaxation of the hand muscles even after hours of using the tool.

Figure 2A:
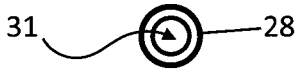
FIG. 2A illustrates top view of the first end of the handle illustrated in FIGS. 1A and 1B, which is cylindrical.
Figure 2B:
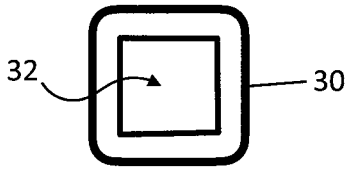
FIG. 2B illustrates top view of the second end of the handle shown in FIGS. 1A and 1B, which is rectangular.

As shown in FIGS. 1A and 1B, elongated ergonomic handle 21 comprises a cylindrical section 26 and a rectangular section 27. Cylindrical section 26 starts at the first end 28 of the handle 21 and constantly increases in diameter to further decrease said diameter up to position 29, wherein there is a transition in geometry from a cylindrical shape to a rectangular shape, thus providing second rectangular section 27, which concludes in second end 30 of the handle 21. First end 28 comprises a cylindrical internal cavity 31, shown in FIG. 2A, while second end 30 comprises an internal rectangular cavity 32, shown in FIG. 2B. Furthermore, first embodiment 20 also comprises a slider button 33, located at the aperture 33*a* on the topside 34 of the rectangular section 27. Elongated ergonomic handle 20 may be made of any suitable rigid, durable material such as molded plastic, resin, metal, or plastic; more preferably, resin or plastic.

Scraper 22 is a stick made of any solid and firm material such as, felt, wood, firm foam, plastic, or other suitable material. It comprises a cylindrical body 35 with a first pointy or tip end 36 and a second diagonal end 37. Scraper 22 may be inserted in a non-permanent manner into the cylindrical internal cavity 31, located at the first end 28 of handle 21.

Figure 3A:
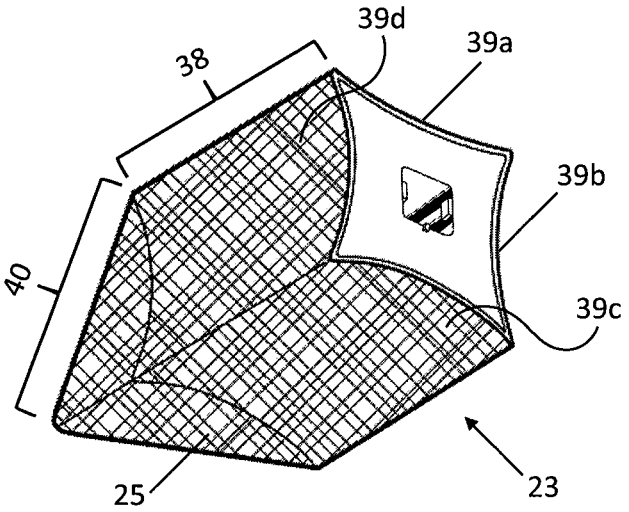
FIG. 3A illustrates the head section of the embodiment shown in FIGS. 1A and 1B.

Head 23 is connected in a non-permanent manner to second end 30 of handle 21. It is disposable or reusable and may be ejected from handle 21 by slider button 33, as explained below. As illustrated in FIG. 3A, head 23 comprises a single unit body with an external geometrical shape having a tridimensional rectangular section 38 with curved or concave lateral sides 39*a*, 39*b*, 39*c* and 39*d*, that are extended continuously into a four-sided pyramidal shape top section 40.

Figure 3B:
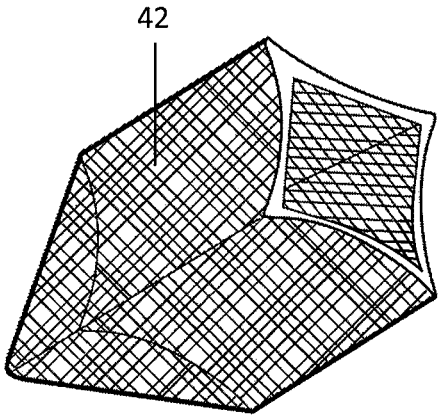
FIG. 3B illustrates a single unit sheath lining of an absorbent material, in a cap-like shape, ready to be adhered to the head's exterior surface of the embodiment illustrated in FIGS. 1A and 1B.

Around the external surface of lateral sides 39*a*, 39*b*, 39*c* and 39*d*, as well as the external surface of corresponding sides of top section 40, head 23 of embodiment 20 also comprises an operational material 25, made of a suitable material capable to absorb and retain fluids, such as felt, polypropylene, cotton, and sponge; more preferably felt or polypropylene. Said operational material of absorbent material is fixed to said sides by means of any suitable covering methods known in the art. Alternatively, the absorbent material may be molded in a single unit or sheath layer 42, as the one illustrated in FIG. 3B, that simulates the shape of the head 23 and which is further fixed to the head 23. Such single unit or sheath layer 42 may be suitably made by heat molding process, in a cap-like shape that fits to cover the upper surface of all the sides 39*a*, 39*b*, 39*c* and 39*d* of rectangular section 38 and corresponding sides of top section 40. Said sheath layer 42 may be fixed to the head 23, by any suitable fixing means known in the art. Any of said fixing means may comprise substances that are resistant to acetone and the like solvents. Such means may include adhesives, such as: hot-melt adhesive, glue, epoxy, double sided adhesive and thermal bonding.

Figure 4A:
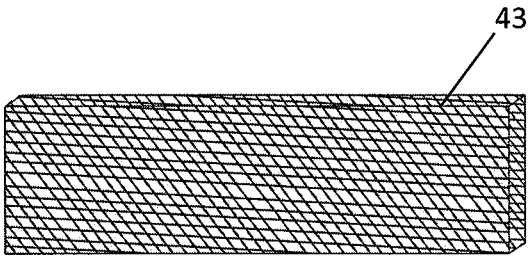
FIG. 4A illustrates a rectangular strip of an absorbent material, useful in an alternate process to adhere said material to the head section of the embodiment shown in FIGS. 1A and 1B.
Figure 4B:
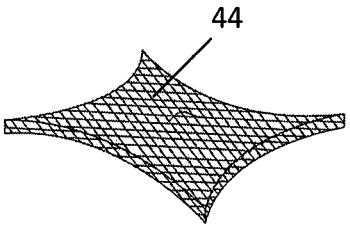
FIG. 4B illustrates a single unit of an absorbent material, useful in an alternate process to adhere said material to the top section of the head section of the embodiment illustrated on FIGS. 1A and 1B.

In some embodiments, a bonding medium, such as an adhesive resistant to acetone and the like solvents, is employed to fix and secure the sheath layer 42 of the selected absorbent material over the surface of head 23. In an alternative method, said operational material may be fix to the lateral sides 39*a*, 39*b*, 39*c* and 39*d* of the head 23 by adhering a rectangular strip 43 of the selected absorbent material, illustrated in FIG. 4A, around the said lateral sides, thus covering the external surface of rectangular section 38. Subsequently, top section 40 is covered by adhering on it a single piece 44 of the absorbent material, as the one illustrated in FIG. 4B.

Figure 5A:
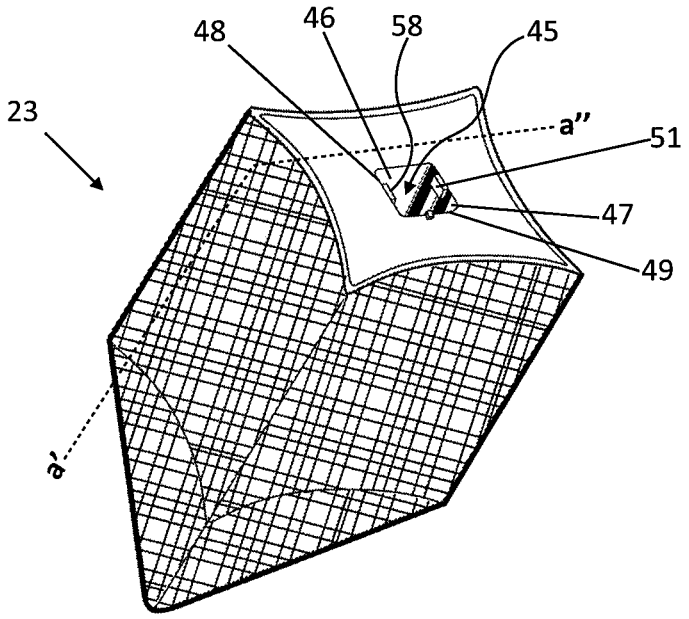
FIG. 5A illustrates a perspective view of the head section of the embodiment illustrated on FIGS. 1A, 1B and 3A.
Figure 5B:
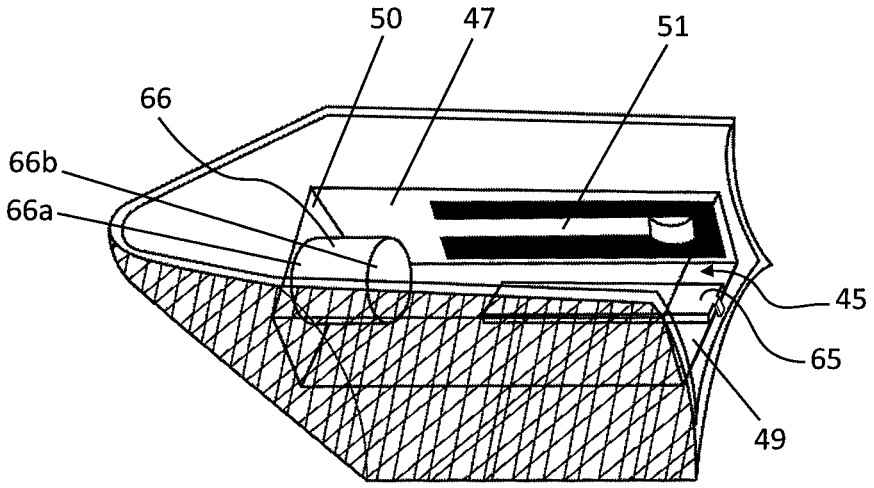
FIG. 5B illustrates a sectional and transversal view after a cut through the plane defined by a'-a" on the head section shown in FIG. 5A.

FIG. 5A represents a perspective view of head 23 disconnected from handle 21. As illustrated, head 23 comprises an internal cavity 45 having a rectangular shape and an exit toward the lower side of said head 23. FIG. 5B illustrates a section of head 23, after a transversal cut through plane defined by a'-a" on FIG. 5A has been performed and is herein presented in order to show details in the interior or inside of head 23. As illustrated in FIGS. 5A and 5B, internal cavity 45 comprises top side 46, right side 47, left side 48, bottom side 49 and a distal flat wall 50.

FIG. 6A illustrates internal surface of right side 47 of internal cavity 45. Said internal surface comprises a first head locking snap 51, which comprises an elongated rectangular body 52 having an upper side 53, a lower side 54, a first end 55 and a second end 56. Said first end 55 is the only section of the locking snap 51 which is connected to the internal surface of internal cavity 45, thus, first head locking snap 51 simulates a free strip, able to move inward or outward in reference to internal surface of internal cavity 45. The first head locking snap 51 also comprises a first wedge 57 located at the second end 56 of the first head locking snap 51.

Similarly, the interior surface of the internal cavity 45 on the left side 48, shown in FIG. 6B, is practically a mirror image of the internal surface of the right side 47 already described: it comprises a second head locking snap 58, which comprises an elongated rectangular body 59 having an upper side 60, a lower side 61, a first end 62 and a second end 63, wherein said first end 62 is the only section of second head locking snap 58 that is connected to the internal surface of internal cavity 45, simulating a free strip, able to move inward or outward in reference to internal surface of internal cavity 45. It also comprises a second wedge 64 located at the second end 63 of the second head locking snap 58.

As illustrated in FIG. 5B, inside internal cavity 45, head 23 also comprises an elongated protruding extension 65 located at substantially or near at substantially the center of bottom side 49 of internal cavity 45 of head 23. It also comprises a protruding cylindrical section 66, having a first end 66*a* and a second end 66*b*, which extends from the center or near the center of the internal distal flat wall 50.

FIG. 7 illustrates a tridimensional and perspective view of head cap 24. It may be made of plastic and simulates the external geometrical shape of head 23. This cap is intended to cover head 23 in order to protect it one it is not being used.

Figure 8:
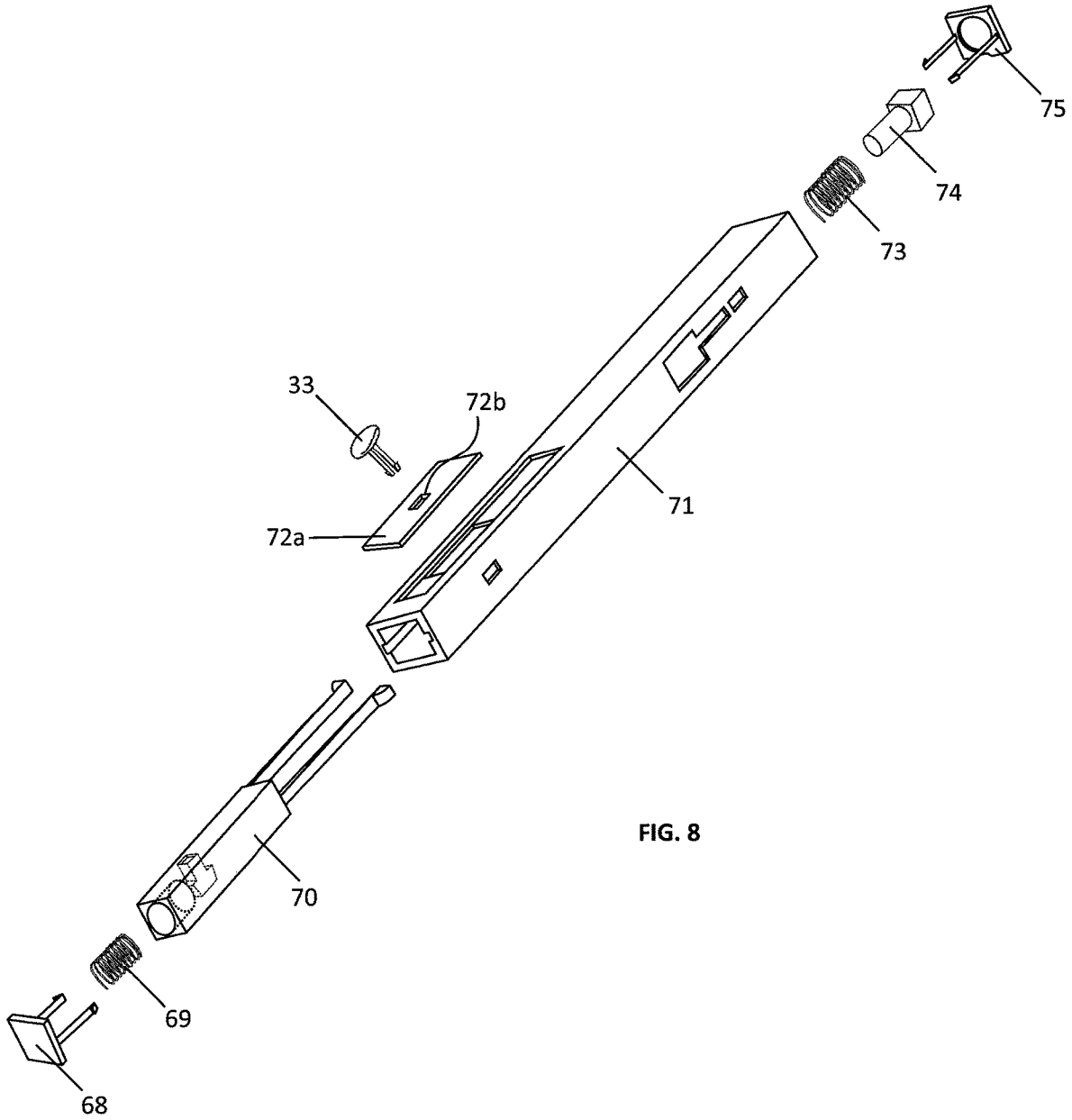
FIG. 8 illustrates exploited view of some parts of the hold/release system, according to the instant invention.

Head 23 is not permanently attached to handle 21 and it may be ejected from said elongated body one the User slides button 33 backwardly. The ejection of head 23 is possible due to a system that allows the hold and release of head 23 on or from handle 21, respectively. As illustrated in FIG. 8, said system comprises first cap 68, first compression spring 69, actuator 70, cartridge 71, cover 72*a*, second compression spring 73, plunger 74, second cap 75 and slider button 33.

Figure 9:
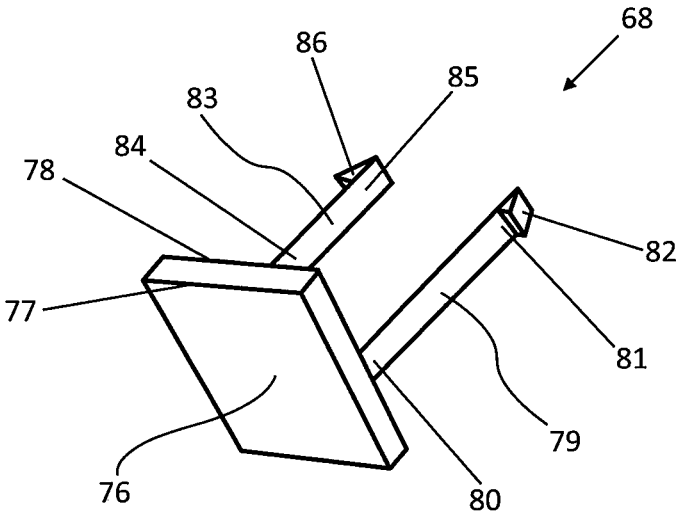
FIG. 9 illustrates an expanded view of the first cap of the hold/release system, previously illustrated in FIG. 8.

Regarding first cap 68, as illustrated in FIG. 9, it comprises a main square body 76 with a front surface 77 and a rear surface 78; it also comprises a first extension 79, having a first end 80 connected to the rear surface 78 on square body 76 and a second end 81. First cap 68 also comprises a first wedge section 82 connected to said second end 81 of the first extension 79. Square body 76 also comprises a second extension 83, having a first end 84 connected to the rear surface 78 on square body 76 and a second end 85. Furthermore, it also comprises a second wedge 86 located at the lateral side of the second end 85 of second extension 83. First extension 79 and second extension 83 are located in a parallel position, in other words, they are aligned in reference to one another while first and second wedges, 82 and 86, are positioned in an outwardly position with reference to the first and second extensions, 79 and 83.

First compression spring 69 and second compression spring 73 are made of any material with sufficient strength to withstand repeated use, for instance plastic, steel or stainless steel, but preferably stainless steel.

Figure 10:
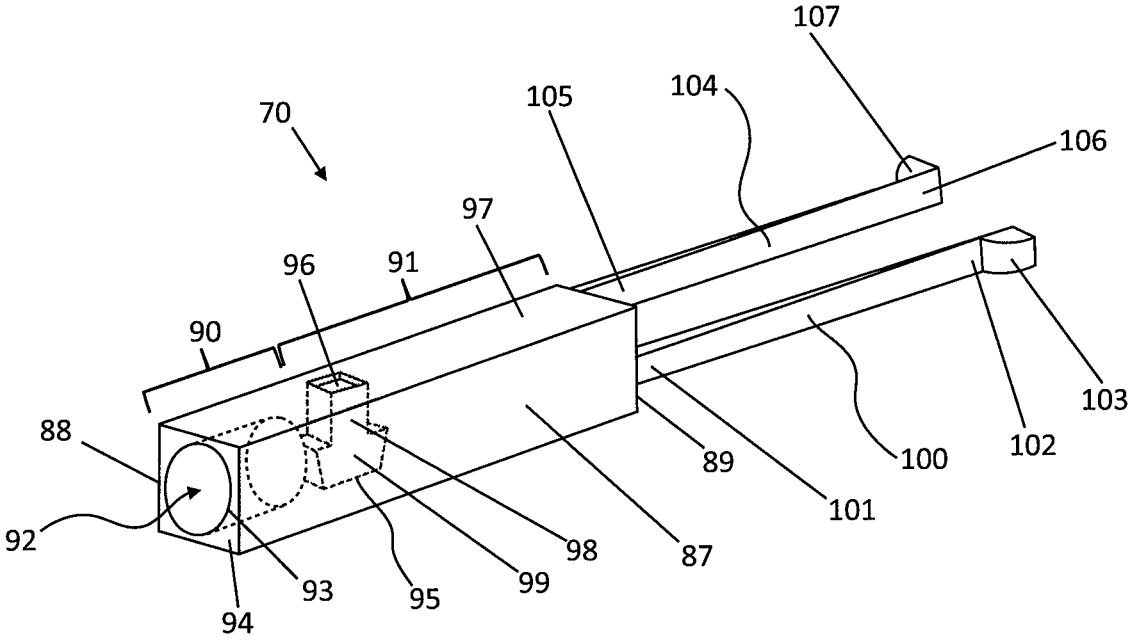
FIG. 10 illustrates expanded view of the actuator of the hold/release system, already illustrated

As illustrated in FIG. 10, actuator 70 comprises: a main rectangular body 87, having a proximal end 88 and a distal end 89; a first section 90; and a second section 91. First section 90 comprises internal cavity 92, which has a round entrance 93 located at the front side 94 of the first section 90. Connected to said first section 90, second section 91 comprises an internal cavity 95, having an opening 96 located on the top side 97 of second section 91. Said opening 96, has a top section 98 and a bottom section 99, wherein the width of the bottom section 99 is broader than the width of the top section 98. With exception of the internal cavity 95, the remaining interior of the second section 91 of the rectangular body 87 is solid.

As shown in FIG. 10 and located at the distal end 89, actuator 70 also comprises a first extension 100, having a first end 101 and a second end 102. It also comprises a first wedge section 103 connected to the lateral side of said second end 102. Similarly, located at the distal end 89 of actuator 70 and in a parallel position with reference to the first extension 100, said actuator 70 also comprises a second extension 104, having a first end 105 and a second end 106. It also comprises a second wedge 107, which is located at the second end 106 of second extension 104.

Figure 11A:
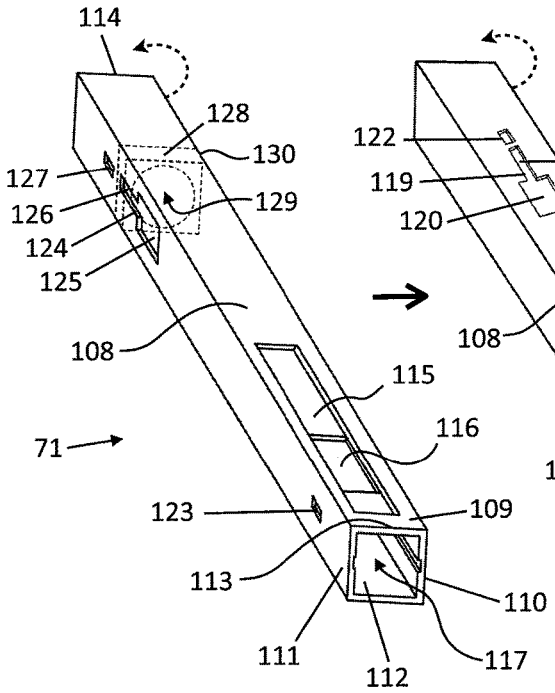
FIGS. 11A, 11B and 11C illustrate different perspective views of the cartridge of the hold/release system, already illustrated in FIG. 8.
Figure 11B:
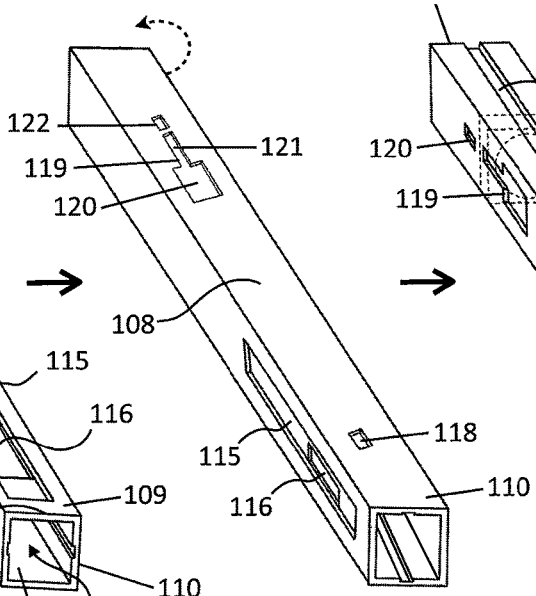
Figure 11C:
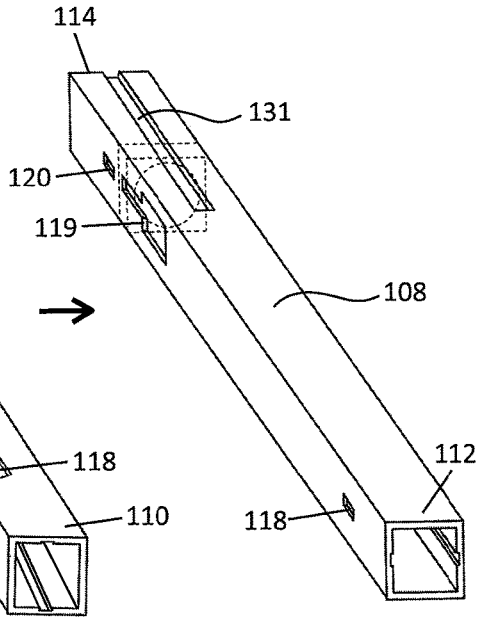

FIGS. 11A, 11B and 11C are expanded, perspective views of cartridge 71. FIG. 11B is the resulting view after FIG. 11A has been rotated ninety degrees to the left. Similarly, FIG. 11C is the resulting view after rotating FIG. 11B ninety degrees to the left. As illustrated in FIGS. 11A, 11B and 11C, cartridge 71 comprises a rectangular hollow body 108 having: a topside 109, a right side 110, a left side 111, a bottom side 112, a proximal end 113, a distal end 114 and hollow internal cavity 117.

On topside 109, near the proximal end 113, it comprises a rectangular depression 115, which has inside a rectangular aperture 116 that is open to the internal cavity 117 of the cartridge 71. On the right side 110, it also comprises: a first aperture 118; a second aperture 119, having section 120 and section 121, wherein section 120 has a broader area in reference to section 121; and a third aperture 122, which is located near the distal end 114 of cartridge 71. Similarly, in the left side 111, it comprises: a first aperture 123; a second aperture 124, having a section 125 and a section 126, wherein section 125 has a larger area than section 126; and a third aperture 127, which is located near the distal end 114 of cartridge 71. The first aperture 118 on the right side 110 is aligned or is in a parallel position with respect to the first aperture 123 on the left side 111, being both of said first apertures, 118 and 123, located near the proximal end 113 of cartridge 71 and, simultaneously, said first apertures, 118 and 123, are aligned to aperture 116 on topside 109. Second aperture 119 on right side 110 is identical in shape to the second aperture 124 on the left side 111. Furthermore, apertures 119 and 124 are aligned to or in a parallel position to one another. Similarly, at the near end of distal end 114 of cartridge 71, the third aperture 122 is aligned to or in a parallel position with third aperture 127. First apertures 118 and 123 of cartridge 71 are intended to position first and second wedges, 82 and 86, of first cap 68, as explained below.

Cartridge 71 also comprises an inner wall 128, comprising a round opening 129. Said inner wall 128 is located inside the cartridge 71, in the section of the internal cavity 117 situated between the second apertures, 119, 124, and third apertures 122, 127. On the bottom side 112, cartridge 71, near the distal end 114, also comprises rail 131.

Figure 12A:
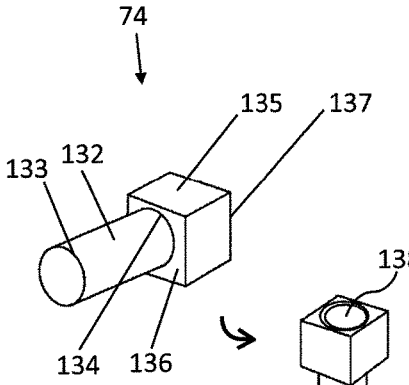
FIGS. 12A and 12B illustrate different views of the plunger of the hold/release system, illustrated previously in FIG. 8.
Figure 12B:
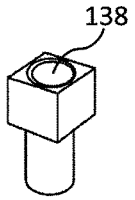
Figure 13:
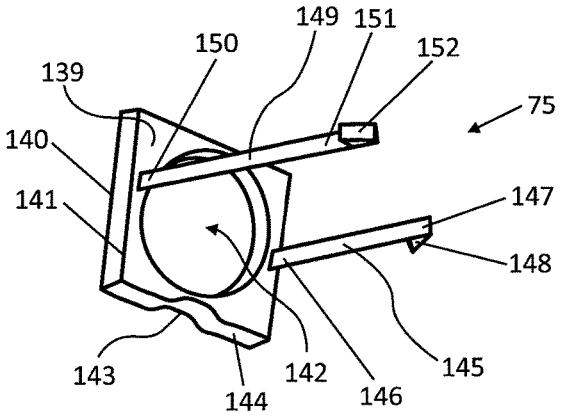
FIG. 13 illustrates an expanded view of the second cap of the hold/release system, already illustrated in FIG. 8.

The hold/release system also comprises a plunger 74, illustrated in FIGS. 12A and 12B, which comprises a cylindrical body 132 having a first end 133 and a second end 134. Plunger 74 also comprises a rectangular section 135, which has a front surface 136 and a rear surface 137. The cylindrical body 132 is attached to the front surface 136 of rectangular section 135. The rear surface 137 has a round depression 138 at its center. Furthermore, the hold/release system comprises a second cap 75, illustrated in an expanded and perspective view on FIG. 13. It is similar to the first cap 68 since it comprises a main square body 139 with a front surface 140 and a rear surface 141. Nonetheless, it comprises a circular opening 142 across said front and rear surfaces, 140, 141, and a carved-out section 143 at the bottom side 144 of said square body 139. Second cap 75 also comprises a first extension 145, having: a first end 146, which is connected to the rear surface 141 of square body 139, and a second end 147.

Second cap 75 also comprises a first wedge section 148 connected to the lateral side of the second end 147 of first extension 145. Second cap 75 also comprises a second extension 149, having: a first end 150, which is connected to the rear surface 141 of square body 139, and a second end 151. It also comprises a second wedge section 152 connected to the lateral side of the second end 151 of second extension 149. First extension 145 and second extension 149 are located in a parallel position with reference to each other.

In other words, said extensions are aligned in reference to one another, while first and second wedges, 148 and 152, are positioned in an outwardly position with reference to the first and second extensions, 145 and 149. Third apertures 122 and 127 of cartridge 71 are intended to position first and second wedges, 148 and 152, of first cap 68, as explained below.

Figure 14:
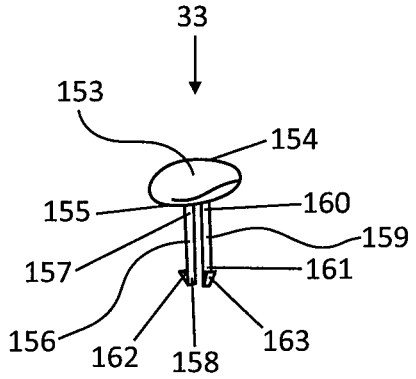
FIG. 14 illustrates an expanded view of the slider button of the hold/release system, illustrated previously in FIG. 8.

The system, capable of hold and release head 23, on or from the handle 21, respectively, also requires the slider button 33. As illustrated in FIG. 14, the said button comprises: a main body 153, having a front surface 154 and a rear surface 155; a first elongated extension 156, having a first end 157 and a second end 158; and a second elongated extension 159, having a first end 160 and a second end 161. First and second elongated extensions, 156 and 159, are connected to the rear surface 155 in a parallel position in reference to one another. Slider button 33 also comprises: first wedge 162, which is positioned laterally in the second end 158 of the first extension 156; and second wedge 163, positioned laterally on second end 161 of the second extension 159. Both, first and second wedges, 162 and 163, are positioned outwardly from the first and second extensions 156 and 159. Bottom section 99 of actuator 70 is intended to position first and second wedges, 162 and 163, of the slider button 33, as explained below.

Figure 15:
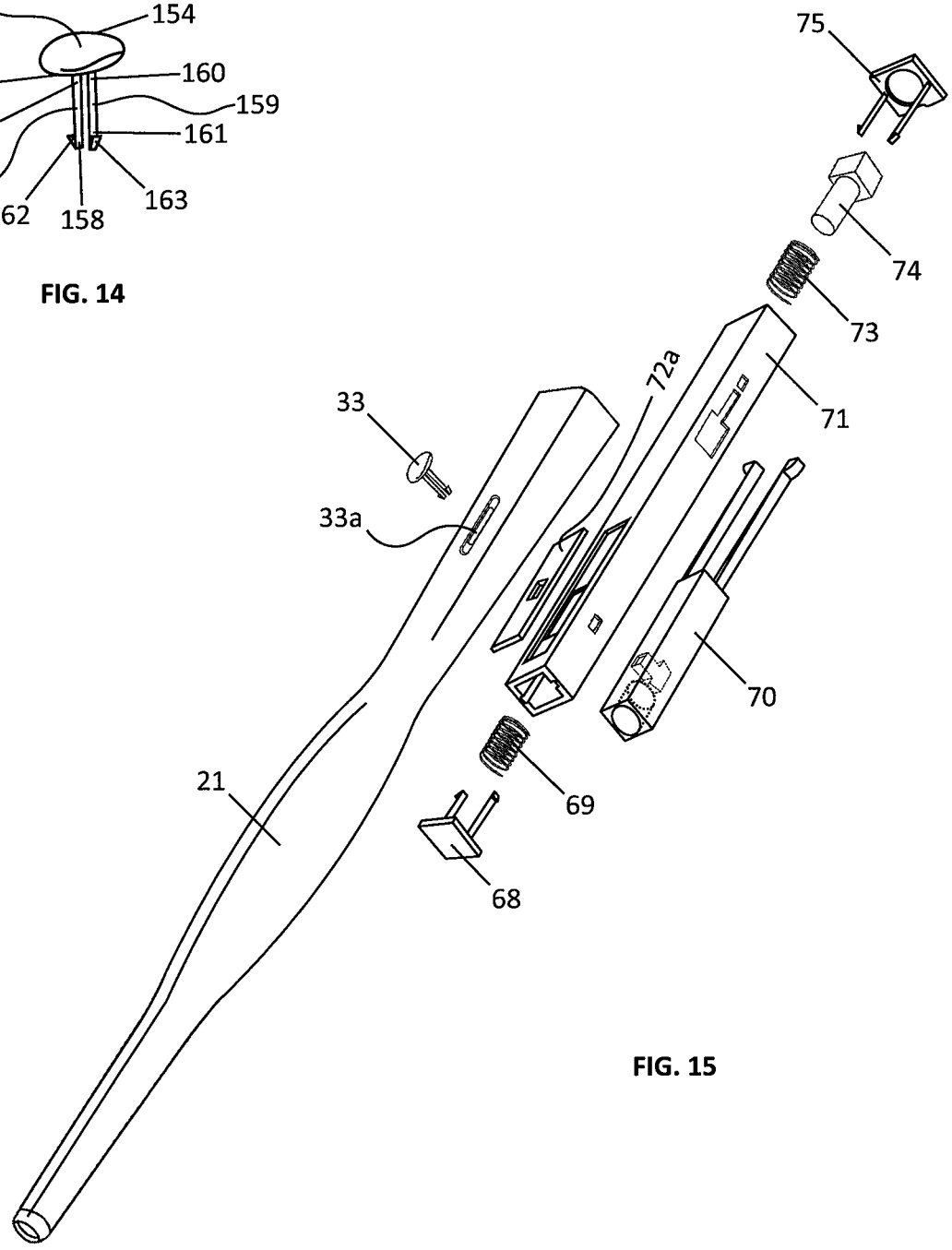
FIG. 15 illustrates a perspective view suggesting the manner in which some of the different sections of the hold/release system are organized inside the rectangular section of the handle, according to the instant invention.

As suggested in FIG. 15, first spring 69 is inserted and enclosed between the aligned first and second extension, 79 and 83, of first cap 68 and the internal cavity 92 of the first section 90 of actuator 70, via round entrance 93. First and second extensions, 100 and 104, of actuator 70 are inserted into the internal cavity 117 of the cartridge 71 through its proximal end 113, until actuator 70 is fully introduced inside internal section 117. Consequently, first wedge 103 and second wedge 107, on first and second extensions 100 and 104 of actuator 70, are positioned on the narrower sections 121 and 126 of the second apertures 119 and 124 from the interior surface of the internal cavity 117 of the cartridge 71, located on the right and left side, 110 and 111, of the cartridge 71. In this manner, first wedge 82 and second wedge 86 of first extension 79 and second extension 83 of first cap 68 are inserted in first aperture 118 and first aperture 123 on the right and left side, 110 and 111, of cartridge 71, restricting first spring 69 to the space between the first cap 68 and the internal section 92 of actuator 70.

As a consequence, aperture 96 on top side 97 of actuator 70 is aligned with aperture 116 on the top side 109 of cartridge 71; first wedge 103 of first extension 100 of actuator 70 is positioned in second aperture 119 on the right side 110 of cartridge 71; and second wedge 107 of second extension 104 of actuator 70 is positioned in second aperture 124 on the left side 111 of cartridge 71. Afterwards, cover 72*a*, which has on its center a rectangular aperture 72*b*, is placed on rectangular depression 115 on topside 109 of cartridge 71. Thus, said aperture 72*b* of cover 72*a* is aligned with aperture 116 on the topside 109 of cartridge 71.

Furthermore, once the cartridge 71 has been assembled with the first cap 68, the first spring 69, actuator 70 and cover 72*a*, as discussed previously, it is inserted at the rectangular section 27 of handle 21. Then, slider button 33 is inserted into aperture 33*a* on topside 34 of handle 21, thus passing through aperture 72*b* of the cover 72*a*, aperture 116 of the cartridge 71 and through the aperture 96 on the actuator 70, since those three apertures, 116, 72*b* and 96, are already aligned. In this manner, first wedge 162 on first extension 156 of the slider button 33 and second wedge 163 of the second extension 159 of the slider button 33 are inserted and secured at broader section 99 on aperture 96 of actuator 70.

On the other hand, second spring 73 is inserted into the cylindrical section 132 of plunger 74; rectangular section 135 of the plunger 74 is inserted between the first extension 145 and second extension 149 of second cap 75. Cylindrical section 132 of plunger 74, having second spring 73 already inserted into it, is then introduced at the distal section 114 of cartridge 71 into the internal cavity 117 of cartridge 71. In this manner, second spring 73 is kept captive between internal wall 130 of cartridge 71 and front surface 136 of rectangular section 135 of plunger 74, since the first wedge 148 on the first extension 145 of the second cap 75 is inserted and secured within the third aperture 122 on the right side 110 of cartridge 71 and the second wedge 152 of the second extension 149 of the second cap 75 is inserted and secured into third aperture 127 on the left side 111 of cartridge 71.

Once the cartridge 71 containing the mentioned different components of the hold/release system, already set up or assembled, is inserted into the rectangular distal section 27 of elongated ergonomic handle 21, the distal section 114 of cartridge 71 is then inserted into the internal rectangular cavity 45 of head 23 by matching rail 131 on the bottom side 112 of cartridge 71 with the elongated protruding extension 65 on the bottom side 49 of rectangular internal cavity 45 on the interior of head 23. By inserting distal section 114 of the cartridge 71 on the interior rectangular cavity 45 inside head 23, the protruding cylindrical section 66 that extends from the center or near the center of the internal distal flat wall 50 enters through the round aperture 142 of second cap 75, matching the round depression 138 on the rear surface 137 of the rectangular section 135 of plunger 74.

In this manner, once the second end 66*b* of protruding cylindrical section 66 is accommodated inside round depression 138 on the rear surface 137 of plunger 74, it pushes and contracts the second spring 73 in between the front surface 136 of plunger 74 and the internal wall 130 on cartridge 71 while the head 23 is connected to the handle 21. As a consequence, first wedge 57 on the first head locking snap 51 is moved along the external surface of the right side 110 of the cartridge 71 until it is inserted and secured on the broader section 120 of the second aperture 119 of the cartridge 71. Simultaneously, the second wedge 64 of the second head locking snap 58 moves along the external surface of the left side 111 of the cartridge 71 until it is inserted and secured on the larger area section 125 of the second aperture 124 of the cartridge 71. Thus, the hold/release system, as already explained, requires the integration of all parts illustrated in FIG. 8 in cooperation with the internal parts located at the rectangular internal cavity 45 of the head section 23, already discussed above.

The release of the head 23 is achieved once the button 33 is moved backwards and released, since extensions 156 and 159 of button 33 pull the actuator 70 backwards, due to the fact that button's wedges, 162 and 163, are secured into the internal cavity 95 of the actuator 70. Such movement presses and compresses the first spring 69. Also, the first and second wedges of the actuator, 103 and 107, respectively, are repositioned from the narrower sections, 121 and 126, to the broader sections 120 and 125, of the second cartridge apertures 119 and 124. Such reposition, simultaneously, results in the release or disconnection of wedges 57 and 64 of first and second head locking snaps, 51 and 58, since they are pushed outwardly from the broader sections 120 and 125 on second apertures 119 and 124. Thus, second spring 73 is free to release its potential energy into kinetic energy that is used in pushing head 23 away from handle 21. In other words, second spring 73 is free to return to its relaxed—non compressed—position and said kinetic energy pushes the head 23 out of the handle 21. It should be noted that the first spring 69, once the slider button 33 is set fee, returns to the decompressed position, liberating kinetic energy that pushes the actuator 70 back to its initial position, re-positioning actuator's wedges 103 and 107 to the narrower sections, of the second apertures 119 and 124 on the right and left sides, 110 and 111, of cartridge 71. The disclosed hold and release system herein described may be adapted to any other item having a removable section.

Figure 16A:
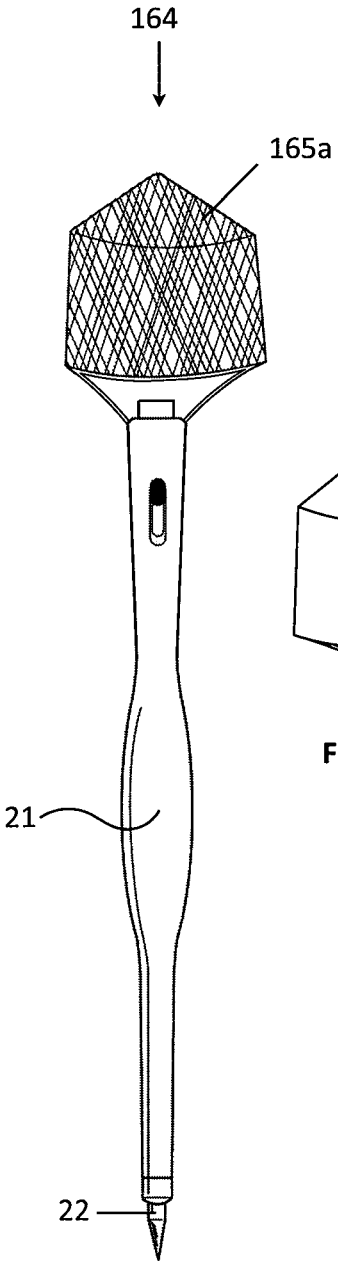
FIGS. 16A and 16B illustrate perspective views of an embodiment of the invention, comprising a head section with three concave lateral sides and its corresponding head cap, respectively.
Figure 16B:
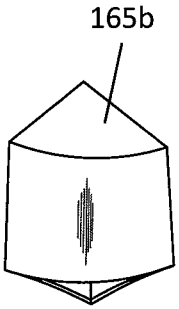
Figure 17A:
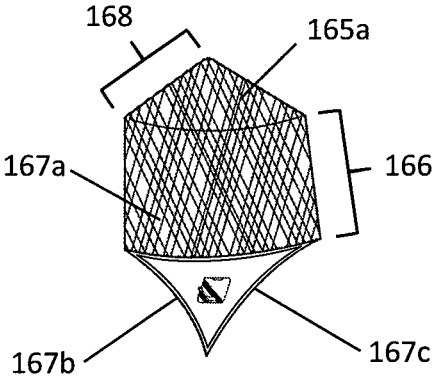
FIGS. 17A and 17B illustrate a perspective view and a top view, respectively, of the head section of the embodiment of the invention illustrated in FIG. 16A.
Figure 17B:
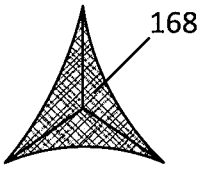

FIG. 16A illustrates embodiment 164 of the invention, while FIG. 16B illustrates the corresponding head cap 165*b* simulating the shape of head section 165*a* of the embodiment 164. As shown in FIGS. 16A and 16B, embodiment 164 comprises the same main external sections of the embodiment 20: a head having an operational absorbent material fixed on its external surface, an elongated ergonomic handle, the same hold/release system above discussed a scraper and a head cap. However, embodiment 164 comprises head 165*a*, which is represented in a perspective view on FIG. 17A and in a top view on FIG. 17B, wherein it is shown that head 165*a* comprises a single unit body with an external geometrical shape having a tridimensional triangular section 166 with curved or concave lateral sides 167*a*, 167*b*, and 167*c*, that are extended continuously into a three sides pyramidal shape top section 168.

Figure 18A:
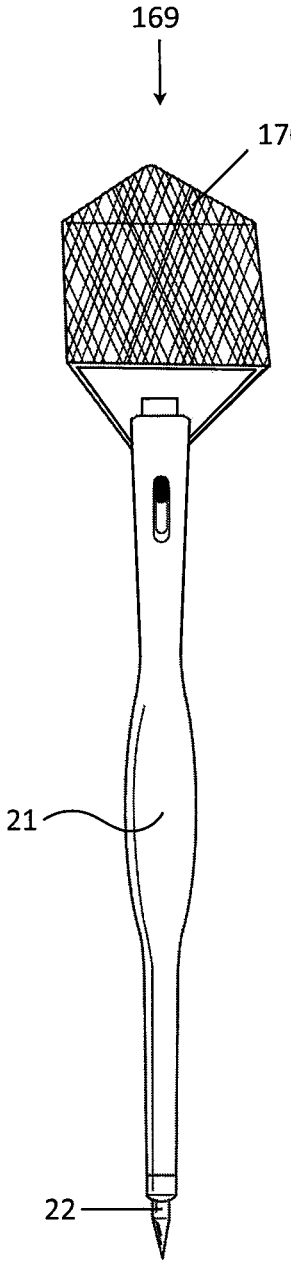
FIGS. 18A and 18B illustrate perspective views of an embodiment of the invention, comprising a head section with three straight lateral sides and its corresponding head cap, respectively.
Figure 18B:
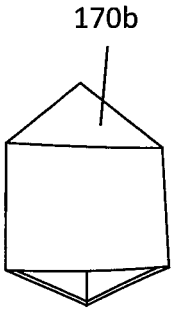
Figure 19A:
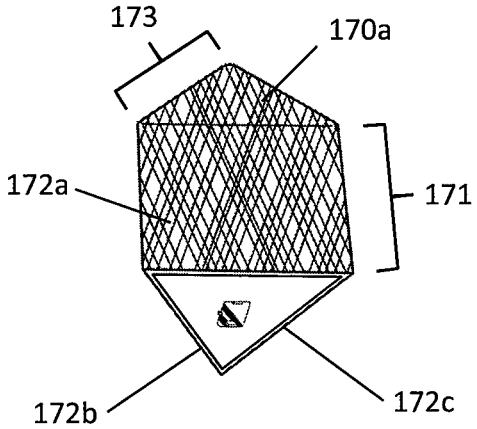
FIGS. 19A and 19B illustrate a perspective view and a top view, respectively, of the head section of the embodiment of the invention illustrated in FIG. 18A.
Figure 19B:
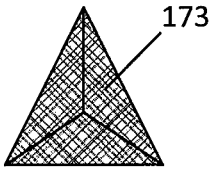

FIG. 18A illustrates embodiment 169 of the invention, while FIG. 18B illustrates the corresponding head cap 170*b* simulating the shape of head section 170*a* of the embodiment 169. As shown in FIGS. 18A and 18B, embodiment 169 comprises the same main external sections of the embodiment 20: a head having as operational material an absorbent material fixed on its external surface, an elongated ergonomic handle, the same hold/release system above discussed a scraper and a head cap. However, embodiment 169 comprises head 170*a*, which is represented in a perspective view on FIG. 19A and in a top view on FIG. 19B, wherein it is shown that head 170*a* comprises a single unit body with an external geometrical shape having a tridimensional triangular section 171 with flat lateral sides 172*a*, 172*b* and 172*c*, that are extended continuously into a three sides pyramidal shape top section 173, as shown in FIGS. 19A and 19B.

FIG. 20A illustrates embodiment 174 of the invention, while FIG. 20B illustrates the corresponding head cap 175*b* simulating the shape of head section 175*a* of the embodiment 174. As shown in FIGS. 20A and 20B, embodiment 174 comprises the same main external sections of the embodiment 20: a head having as the operational material an absorbent material fixed on its external surface, an elongated ergonomic handle, the same hold/release system above discussed a scraper and a head cap. However, embodiment 174 comprises head 175*a*, which is represented in a perspective view on FIG. 21A and in a top view on FIG. 21B, wherein it is shown that head 175*a* comprises a single unit body with an external geometrical shape having a tridimensional rectangular section 176 with two curved or concave lateral sides, 177*a* and 177*b*, and two flat lateral sides, 178*a* and 178*b*, that are extended continuously into a four sides pyramidal shape top section 179, as shown in FIGS. 21A and 21B.

Figure 22A:
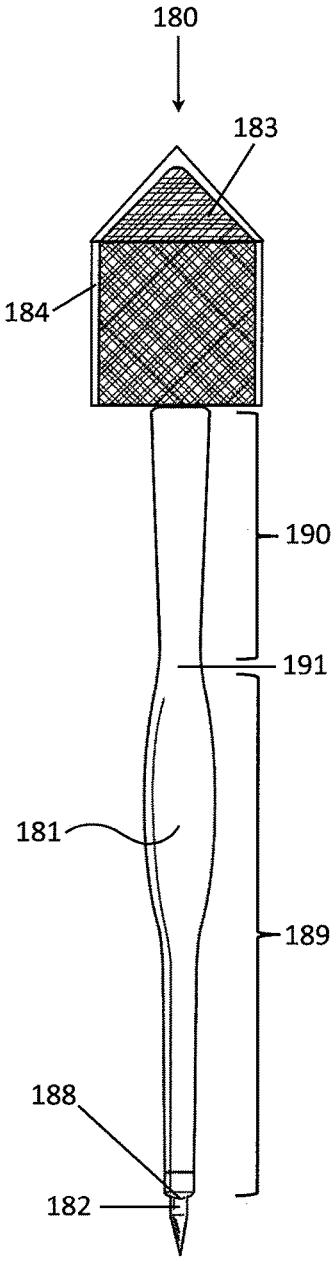
FIG. 22A shows a front view of an embodiment of the tool with its corresponding head cap on, according to the instant invention, wherein the different components of the tool are assembled.
Figure 22B:
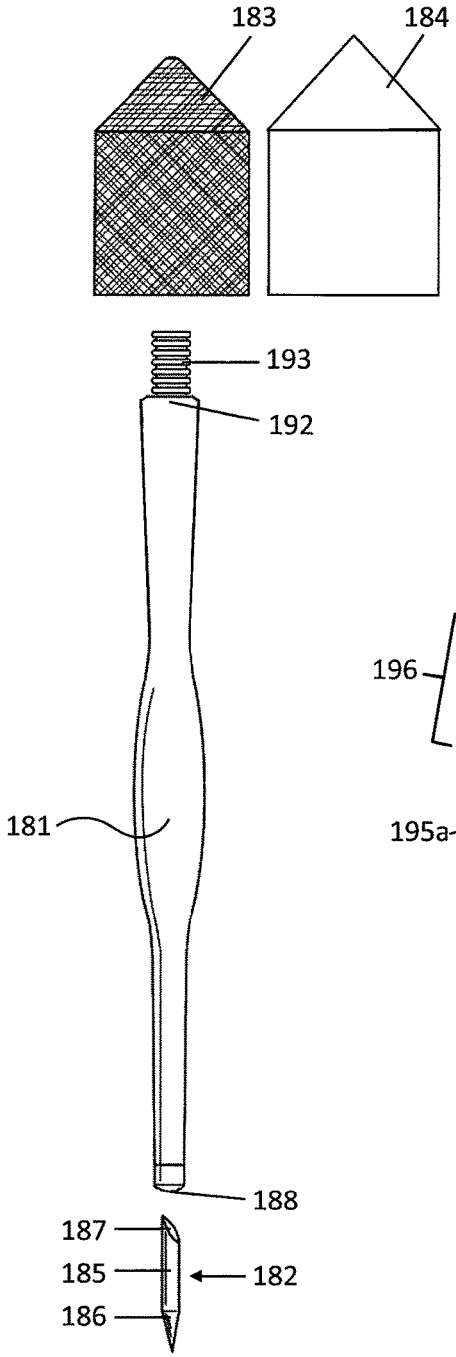
FIG. 22B illustrates the embodiment shown in FIG. 22A, wherein the different components of the invention are separated.

FIGS. 22A and 22B illustrate embodiment 180 of the invention. FIG. 22A illustrates embodiment 180 already assembled, while FIG. 22B shows individual parts of embodiment 180. It comprises elongated ergonomic handle 181, scraper 182, head 183 and head cap 184. Embodiment 180 also comprises a threaded male/female system in order to connect or disconnect head 183 to or from handle 181, respectively, by simply screwing or unscrewing the head 183 to or from handle 181.

As already described regarding embodiment 20, scraper 182 is a stick made of any solid and firm material such as: felt, wood, firm foam, plastic, or other suitable material. It comprises a cylindrical body 185 with a first pointy or tip end 186 and a second diagonal end 187. Scraper 182 may be inserted in a non-permanent manner to the first end 188 of elongated ergonomic handle 181.

Regarding elongated ergonomic handle 181, it comprises a cylindrical section 189 and a rectangular section 190. Cylindrical section 189 starts at the first end 188 and constantly increases in diameter to further decrease said diameter up to a point 191, wherein the second rectangular section 190 starts, which concludes in second end 192. Attached to said second rectangular section 190, it comprises an elongated threaded cylindrical section 193.

Figure 23A:
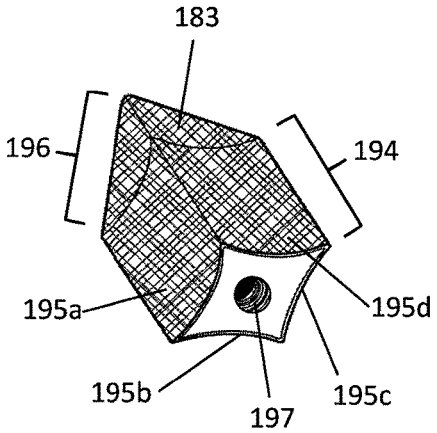
FIGS. 23A and 23B illustrate perspective and top views, respectively, of the head section of the embodiment illustrated in FIGS. 22A and 22B, which comprises a head section with four concave lateral sides and a four sides pyramidal top section.
Figure 23B:
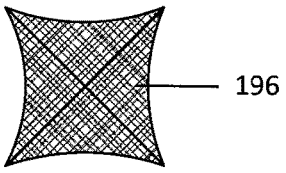

FIG. 23A illustrates a perspective view of head 183, while FIG. 23B illustrates its top view. It comprises a single unit body with an external geometrical shape, having a tridimensional rectangular section 194 with curved or concave lateral sides 195*a*, 195*b*, 195*c* and 195*d*, that are extended continuously into a four sides pyramidal shape top section 196, as shown in FIG. 23B. Head 183 also comprises an internally threaded opening 197, with an exit toward the lower side of the head 183, as shown in FIG. 23A, which is cooperatively adapted to the threaded cylindrical section 193 on handle 181. Thus, in this embodiment 180, handle 181 is connected and disconnected to head 183 by means of inserting threaded cylindrical section 193 on threaded opening 197 and screwing or unscrewing it, respectively. Similar to head 23 of embodiment 20 of the instant invention, head 183 comprises an operational material 25 fixed on its external surface, which is made of a suitable material capable to absorb and retain fluids, such as felt, polypropylene, cotton, and sponge; more preferably felt or polypropylene.

Head cap 184 is made of plastic and simulates the external shape of head 183. This cap is intended to cover head 183 in order to protect it one it is not being used.

FIG. 24A illustrates embodiment 199 of the invention. FIG. 24B illustrates the corresponding head cap 204 for embodiment 199 and FIG. 24C shows a top view of embodiment 199. Embodiment 199 comprises the same main external sections of the embodiment 180: a head having an operational material of absorbent material fixed on its external surface, an elongated ergonomic handle, the same male/female holding system above discussed, a scraper and a head cap. However, embodiment 199 comprises head 200, which has a single unit body with an external geometrical shape having a tridimensional triangular section 201 with curved or concave lateral sides 202*a*, 202*b* and 202*c*, that are extended continuously into a three sides pyramidal shape top section 203, shown in FIG. 24C. As mentioned previously, head cap 204 simulates the external geometrical shape of head 200.

FIG. 25A illustrates embodiment 205 of the invention, comprising same main external sections of the embodiment 180: a head having as the operational material an absorbent material fixed on its external surface, an elongated ergonomic handle, the same male/female holding system already discussed above, a scraper and a head cap. However, in embodiment 205, head 206 comprises a single unit body with an external geometrical shape having a tridimensional triangular section 207 with flat lateral sides 208*a*, 208*b* and 208*c* that are extended continuously into a three sides pyramidal shape top section 209, shown in FIG. 25C. Head cap 210 simulates the external shape of head 206, as shown in FIG. 25B.

Figure 26A:
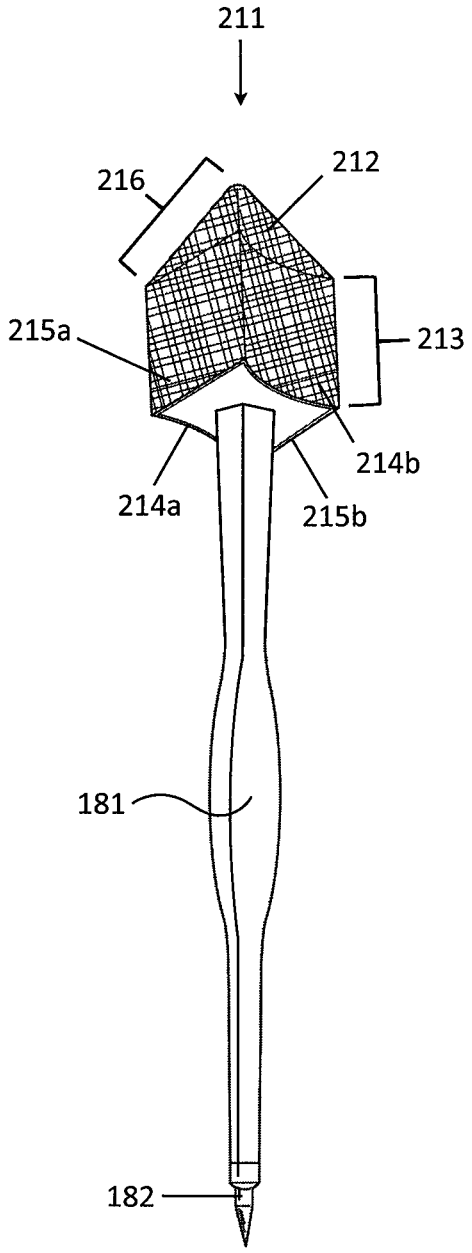
FIGS. 26A and 26B illustrate a perspective view of an embodiment of the invention, comprising a head section with two concave sides and two straight sides, and its corresponding head cap, respectively.
Figure 26B:
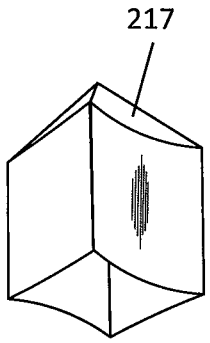
Figure 26C:
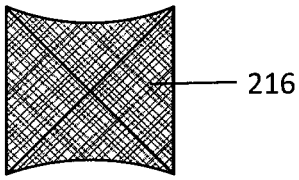
FIG. 26C illustrates a top view of the head section of the embodiment illustrated in FIG. 26A, which has a four sides pyramidal shape.

FIG. 26A illustrates embodiment 211 of the invention, comprising same main external sections of the embodiment 180: a head having as the operational material an absorbent material fixed, attached, or adhered on its external surface, an elongated ergonomic handle, the same male/female holding system above discussed, a scraper and a head cap. However, in embodiment 211, head 212 comprises a single unit body with an external geometrical shape having a tridimensional rectangular section 213 with two curved or concave lateral sides, 214*a* and 214*b*, and two flat lateral sides, 215*a* and 215*b*, that are extended continuously into a four sides pyramidal shape top section 216, shown in FIG. 26C. As illustrated in FIG. 26B, head cap 217 simulates the external shape of head 212.

The scope of this invention also comprises embodiments directed to tools useful in buffing nails, wherein, the operational material fixed on the external surface of the head section of the tool is abrasive material in place of an absorbing material. Specifically, said abrasive material is fixed, attached, or adhered to the external surface of the lateral sides of the head section of the tool. For instance, as illustrated in FIG. 27A, embodiment 218 comprises an elongated ergonomic handle 21, scraper 22, head 221, and the same hold/release system already discussed to separate the head 23 from the handle 21. Handle 21 also comprises a cylindrical section 26 and a rectangular section 27. Embodiment 218 illustrates a resilient pad comprising a film of buffing material adhered to head 221, thus it represents a buffing tool.

Head 221 is connected to handle 21 by means of the same hold/release system described above for embodiment 20 and is reusable. Head 221 comprises a single unit body with an external geometrical shape having a tridimensional rectangular section 223 with flat lateral sides 224*a*, 224*b*, 224*c* and 224*d*, and a flat topside 224*e*. Said flat lateral sides have fixed, adhered, or attached a resilient pad 225, having a front surface 226 with a film of adhesion material and a back surface 227 comprising, as the operational material, a film of buffing material 228. Such resilient pad 225 may be made of foam or rubber. The buffing material, which is commercially available with and without a resilient pad, has a variety of grits or coarseness. In one of the preferred embodiments, the buffing material fixed, adhered, or attached being used in the lateral sides 224*a*, 224*b*, 224*c* and 224*d* are of different grits. In other preferred embodiments, it may be of the same grit or any other combination of grits. For instance, one of the said lateral sides may have fixed, adhered, or attached a resilient pad coated with a coarse-grit abrasive layer, other of the lateral sides may have fixed, adhered, or attached a resilient pad with a medium-grit abrasive layer, while other lateral side may have fixed, adhered, or attached a resilient pad coated with a fine-grit abrasive layer. The remaining lateral side may have fixed, adhered, or attached to them a resilient material with an extra fine grit abrasive layer, such as those made out of Teflon.

Each resilient material pad 225 is fixed securely to the lateral sides 224*a*, 224*b*, 224*c* and 224*d* of head 221 by any suitable bonding means compatible with the resilient material being used, including but not limited to gluing, cementing, and bonding. Such means include adhesives, such as: hot-melt adhesive, glue, double sided adhesive, and thermal bonding. In a preferred embodiment, a bonding medium, such as an adhesive, is employed to fix and secure each resilient material pad 225 to the lateral sides 224*a*, 224*b*, 224*c* and 224*d*. As illustrated in FIG. 27B, head cap 222 simulates the external shape of head 221.

FIG. 28A illustrates embodiment 229 of the instant invention, which comprises the same main external sections of the embodiment 218: a head having fixed, adhered, or attached on the external surface of its lateral sides a resilient pad comprising a film of buffing material 228, an elongated ergonomic handle, the same hold/release system described above for embodiment 20, a scraper and a head cap. However, in embodiment 229, head 230 comprises a single unit body with an external geometrical shape having a tridimensional rectangular section 231 with concave or curved lateral sides 232*a*, 232*b*, 232*c* and 232*d*, and a flat topside 232*e*. Head cap 233, shown in FIG. 28B, simulates the external shape of head 230.

FIG. 29A illustrates embodiment 234 of the instant invention, which comprises the same main external sections of the embodiment 218: a head having fixed, adhered, or attached on the external surface of its lateral sides a resilient pad comprising a film of buffing material 228, an elongated ergonomic handle, the same hold/release system described above for embodiment 20, a scraper and a head cap. However, in embodiment 234, head 235 comprises a single unit body with an external geometrical shape having a tridimensional triangular section 236 with flat lateral sides 237*a*, 237*b* and 237*c*, and a flat topside 237*d*. As illustrated in FIG. 29B, head cap 238 simulates the external shape of head 235.

FIG. 30A illustrates embodiment 239 of the instant invention, which comprises the same main external sections of the embodiment 218: a head having fixed, adhered, or attached on the external surface of its lateral sides a resilient pad comprising a film of buffing material 228, an elongated ergonomic handle, the same hold/release system described above for embodiment 20, a scraper and a head cap. However, in embodiment 239, head 240 comprises a single unit body with an external geometrical shape having a tridimensional triangular section 241 with concave or curved lateral sides 242*a*, 242*b* and 242*c*, and a flat top side 242*d*. As shown in FIG. 30B, head cap 243 simulates the external shape of head 240.

FIG. 31A illustrates embodiment 244 of the instant invention. It comprises the same main external sections of the embodiment 180: a head, an elongated ergonomic handle, the same male/female holding system already discussed above, a scraper and a head cap. However, in embodiment 244, head 247 comprises a single unit body with an external geometrical shape having a tridimensional rectangular section 249 with flat lateral sides 250*a*, 250*b*, 250*c* and 250*d*, and a flat topside 250*e*. As illustrated in FIG. 31B, head cap 248 simulates the external shape of head 247. In addition, said lateral sides of head 247 have fixed, adhered, or attached on its external surface a resilient pad comprising a film of buffing material 228.

FIG. 32A illustrates embodiment 251 of the instant invention, which comprises the same main external sections of the embodiment 244: a head having fixed, adhered, or attached on the external surface of its lateral sides a resilient pad comprising a film of buffing material 228, an elongated ergonomic handle, the same male/female holding system described above for embodiment 180, a scraper and a head cap. However, in embodiment 251, head 252 comprises a single unit body with an external geometrical shape having a tridimensional rectangular section 253 with concave or curved lateral sides 254*a*, 254*b*, 254*c* and 254*d*, and a flat topside 254*e*. Head cap 255, illustrated in FIG. 32B, simulates the external shape of head 252.

FIG. 33A illustrates embodiment 256 of the instant invention, which comprises the same main external sections of the embodiment 244: a head having fixed, adhered, or attached on the external surface of its lateral sides a resilient pad comprising a film of buffing material 228, an elongated ergonomic handle, the same male/female holding system described above for embodiment 180, a scraper and a head cap. However, in embodiment 256, head 257 comprises a single unit body with an external geometrical shape having a tridimensional triangular section 258 with flat lateral sides 259*a*, 259*b* and 259*c*, and a flat topside 259*d*. As illustrated in FIG. 33B, head cap 260 simulates the external shape of head 257.

FIG. 34A illustrates embodiment 261 of the instant invention, which comprises the same main external sections of the embodiment 244: a head having fixed, adhered, or attached on the external surface of its lateral sides a resilient pad comprising a film of buffing material 228, an elongated ergonomic handle, the same male/female holding system described above for embodiment 180, a scraper and a head cap. However, in embodiment 261, head 262 comprises a single unit body with an external geometrical shape having a tridimensional triangular section 263 with concave or curved lateral sides 264*a*, 264*b* and 264*c*, and a flat topside 264*d*. As shown in FIG. 34B, head cap 265 simulates the external shape of head 262.

Figure 35:
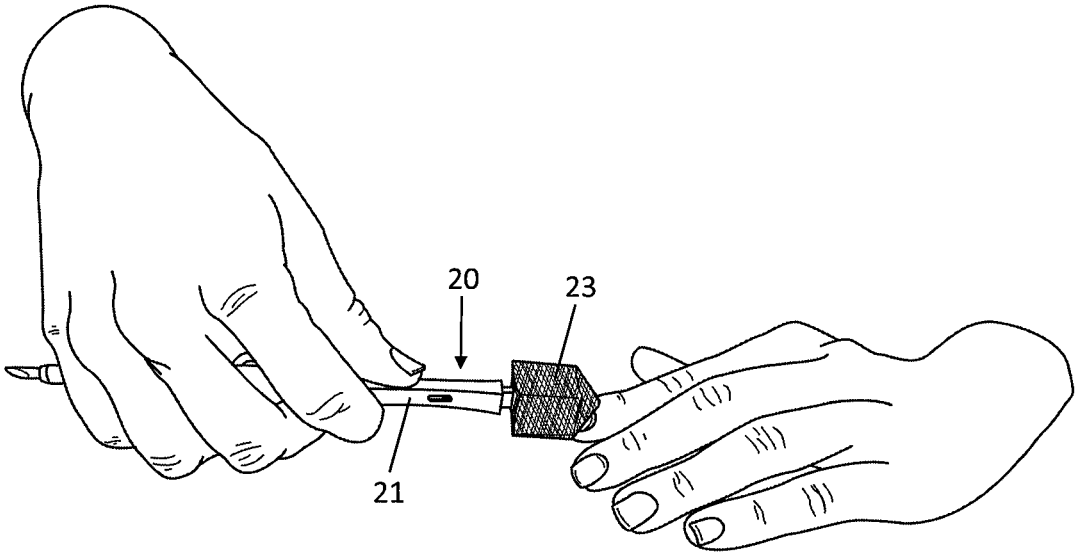
FIGS. 35 to 37 show different manners of using the tool according to the instant invention.

In operational terms, the use of the applicator tool 20 is illustrated in FIG. 35, wherein the User first grabs the handle 21 with one hand and, after saturating the absorbent material fixed, attached, or adhered to the head section of the tool with enamel solvent, proceeds to rub the saturated section of the applicator head 23 over the nail polish to be removed on the nails of the opposite hand. This rubbing action removes the nail polish therefrom. More specifically, the handle 21 is hold with its center in the hand palm while the thumb of the user is resting on the rectangular section 27 and the applicator head 23 is being used to remove the nail polish from a nail.

Figure 36:
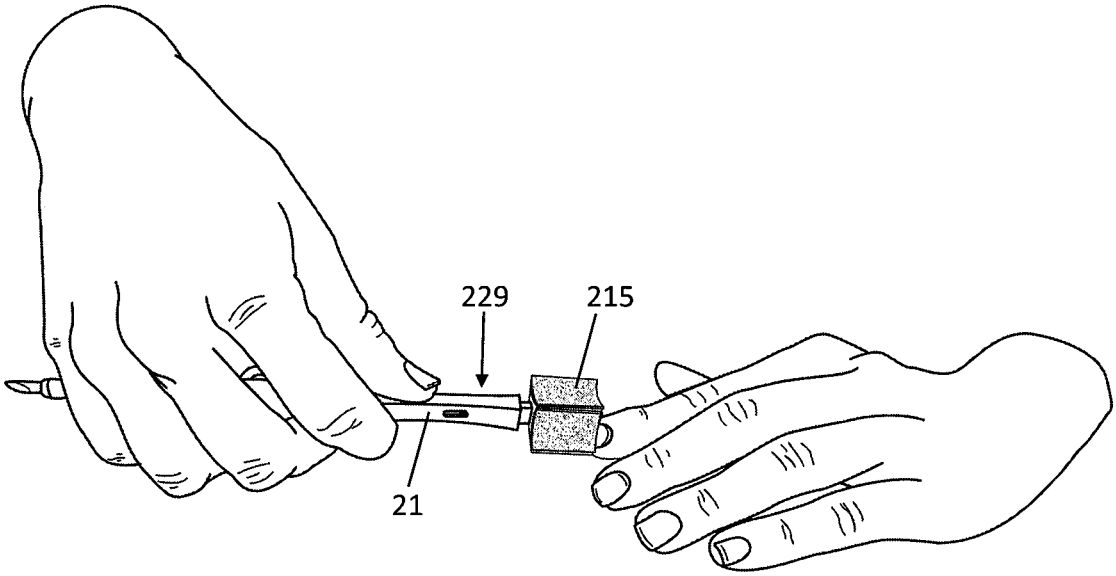

On the other hand, the use of the buffing tool 229, as herein disclosed, is illustrated in FIG. 36. As shown, the User grabs the handle 21 with one hand and buffs one of their nails in the other hand. As can be seen in FIG. 36, the buffing tool 229 is hold with the center of the ergonomic elongated handle 21 resting inside the hand's palm while the thumb of the user is resting on the rectangular section 27 and the head 215 is being used to buff a nail.

Figure 37:
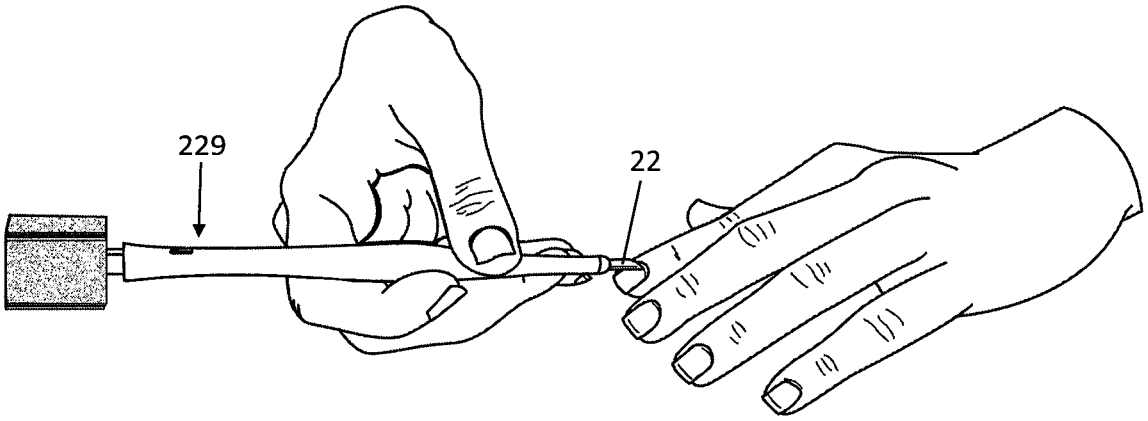

On FIG. 37, the use of the scraper 22 is illustrated. The User is shown removing the remains of materials. The scraper 22 is useful to clean the nail, in detail, around cuticle areas.

Finally, while the present invention has been described in terms of particular embodiments and applications, in both summarized and detailed forms, it will be understood that many substitutions, changes and variations in the described embodiments, applications and details of the novel tool illustrated herein and of its operation can be made by those skilled in the art to adapt it to various usages and conditions, without departing from the spirit of this invention. As such, these changes and modifications are properly, equitably, and intended to be within the full range of equivalence of the followings. While the invention has been described in conjunction with some embodiments, it is to be understood that many alternatives, modifications, and variations will be apparent to those skilled in the art in light of the forgoing description. Accordingly, the invention is intended to embrace all such alternatives, modifications and variations falling within the spirit and scope of the appended claims.

What is claim is:

1. A nail care tool comprising:

A. a handle, said handle comprising an ergonomic elongated body; and said ergonomic elongated body further comprising: 1) a cylindrical elongated section having a first end and a second end; 2) a rectangular elongated section having a first end, connected to the second end of the cylindrical elongated section, and a second end; 3) a first internal cavity located inside the first end of the cylindrical elongated section; 4) a second internal cavity located inside the second end of the elongated rectangular section; 5) an aperture on the rectangular elongated section in direct communication with the second internal cavity;

B. a head section comprising:

(1) a main body, having an external surface and a lower side;

(2) an internal rectangular cavity, located inside of the head main body with an exit toward the lower side, said internal rectangular cavity comprising: a) a top side, b) a right side, c) a left side, d) a bottom side and e) a distal flat wall;

(3) a first head locking snap, located in the right side of the internal rectangular cavity situated inside the main body of the head section, said first head locking snap comprising an elongated rectangular body able to move inward and outward in reference to the interior of the internal rectangular cavity located inside of the main body of the head section; and said elongated rectangular body further comprising: a) an upper side, b) a lower side, c) a first end connected to the internal rectangular cavity and a d) second end;

(4) a wedge connected to the second end of the elongated rectangular body of the first head locking snap and positioned in direction of the interior of the internal rectangular cavity, located inside of the main body of the head section;

(5) a second head locking snap, located in the left side of the internal rectangular cavity located inside of the head main body, said second head locking snap comprising an elongated rectangular body able to move inward and outward in reference to the interior of the internal rectangular cavity located inside of the main body of the head section; and said elongated rectangular body further comprising: a) an upper side, b) a lower side, c) a first end connected to the internal rectangular cavity and a d) second end;

(6) a wedge connected to the second end of the elongated rectangular body of the second head locking snap and positioned in direction of the interior of the internal rectangular cavity, located inside of the main body of the head section;

(7) an elongated protruding extension, located along the bottom side of the internal rectangular cavity of the main body of the head section;

(8) a protruding cylindrical section that extends from the internal distal flat wall to the interior of the internal rectangular cavity, located inside of the main body of the head section;

(9) an operational material, fixed on the external surface of the main body of the head section;

C. a slider button comprising:

(2) a main body having a front surface and a rear surface;

(3) a first elongated extension, having a first end, connected to the rear surface of the main body of the slider button, and a second end;

(4) a second elongated extension, having a first end, connected to the rear surface of the main body of the slider button in a parallel position in reference to the first elongated extension, and a second end;

(5) a first wedge connected laterally to, and pointing outwardly from, the second end of the first elongated extension connected to the rear surface of the main body of said slider button;

(6) a second wedge connected laterally to, and pointing outwardly from, the second end of the second elongated extension connected to the rear surface of the main body of said slider button;

D. a first cap, said first cap comprising:

(1) a square body, having a front surface and a rear surface;

(2) a first elongated extension, having a first end, connected to the rear surface on the square body, and a second end;

(3) a second elongated extension, having a first end, connected to the rear surface of the square body in a parallel position in reference to the first elongated extension, and a second end;

(4) a first wedge connected to, and pointing outwardly from, the lateral side of said second end of the first elongated extension connected to the rear surface of square body;

(5) a second wedge connected to, and pointing outwardly from, the lateral side of the second end of second elongated extension connected to the rear surface of square body;

E. a second cap comprising:

(1) a main square body having a front surface, a rear surface, a circular opening across said front and rear surfaces, and a carved-out section on one of the sides of said main square body;

(2) a first elongated extension having a first end, connected to the front surface of said square body, and a second end;

(3) a second elongated extension having a first end, connected to the front surface of said square body and located parallel to the first elongated extension, and a second end;

(4) a first wedge section connected to, and pointing outwardly from, the lateral side of said second end of the first elongated extension connected to the front surface of said square body of said second cap;

(5) a second wedge, connected to, and pointing outwardly from, the lateral side of the second end of the second elongated extension that is connected to the front surface of said square body of said second cap;

F. a first compression spring, having a first end and a second end;

G. a second compression spring, having a first end and a second end;

H. an actuator comprising:

(1) a main rectangular body, said main rectangular body comprising: a) a proximal end; b) a distal end; c) a first section comprising an internal cavity, having a round entrance that is located at the proximal end of the main rectangular body; d) a second section comprising an internal cavity, having a top section and a bottom section, wherein the internal width of said top section is narrower than the width of said bottom section, and wherein said internal cavity is located in a parallel position with reference to the internal cavity located at the proximal end of the main rectangular body;

(2) a first elongated extension having a first end, connected to the distal end of said main rectangular body, and a second end;

(3) a second elongated extension having a first end, connected to the distal end of said main rectangular body and in parallel position with reference to the first elongated extension, and a second end;

(4) a first wedge connected to, and pointing outwardly from, the lateral side of said second end of the first elongated extension that is connected to the distal end of said main rectangular body;

(5) a second elongated wedge, connected to, and pointing outwardly from, the lateral side of the second end of the second extension that is connected to the distal end of said main rectangular body;

I. a cartridge comprising:

(1) a rectangular hollow body having: a) a top side, b) a right side, c) a left side, d) a bottom side, e) a proximal end and f) a distal end;

(2) a rectangular depression, located on said top side and near the proximal end of the rectangular hollow body;

(3) a first aperture, located inside the rectangular depression located on said top side and near the proximal end of the rectangular hollow body;

(4) a second aperture passing through the right side of rectangular hollow body and in a parallel position with reference to the first aperture located inside the rectangular depression on the top side of the hollow body;

(5) a third aperture passing through the left side of rectangular hollow body, in a parallel position with reference to the second aperture and in a parallel position with reference to the first aperture located inside the rectangular depression on the top side of the hollow body;

(6) a wall, located in the interior of said rectangular hollow body, said wall comprising an internal circular opening;

(7) a fourth aperture passing through the right side of the rectangular hollow body and adjacent to the right side of said wall at the interior of said rectangular hollow body, said fourth aperture comprising: a) a first section and b) a second section, wherein said first section has a broader area in reference to the second section;

(8) a fifth aperture passing through the left side of the rectangular hollow body and adjacent to the right side of said wall at the interior of said rectangular hollow body, said fourth aperture comprising: a) a first section and b) a second section, wherein said first section has a broader area in reference to the second section;

(9) a sixth aperture passing through the right side of the hollow rectangular body and adjacent to the right side of said wall at the interior of said rectangular hollow body;

(10) a seventh aperture passing through the left side of the hollow rectangular body and adjacent to the right side of said wall at the interior of said rectangular hollow body;

(11) a rail, located on the bottom side of the rectangular hollow body;

J. a flat rectangular cover;

K. a plunger comprising:

(1) a square section having a front surface and a rear surface;

(2) a cylindrical section, having a first end and a second end, connected to the front surface of the square section;

(3) a rounded depression, located at the center of the rear surface of said square section;

wherein a hold/release system capable of fastening and holding the head section to the handle section is formed when:

(a) the first spring is enclosed between the aligned first and second elongated extensions of the first cap and the internal cavity, having a rounded entrance, that is located at the proximal end of the main rectangular body of said actuator;

(b) the first and second extensions of the actuator are inserted through the proximal end of the rectangular hollow body of the cartridge until actuator is fully introduced inside said hollow cavity, causing that:

i. the first wedge, connected to the distal end of said main rectangular body of said actuator, to be positioned on the second section of the fourth aperture, passing through the right side of the rectangular hollow body of the cartridge;

ii. the second wedge, connected to the distal end of said main rectangular body of said actuator, is positioned on the second section of the fifth aperture, passing through the left side of the rectangular hollow body; and, simultaneously, iii. the first wedge and second wedge, on the first elongated extension and the second elongated extension of the first cap, respectively, are inserted through the second and third apertures, located in the right and left sides of the rectangular hollow body of the cartridge, respectively, enclosing first spring between the first cap and the internal cavity, having a rounded entrance, that is located at the proximal end of the main rectangular body of said actuator; and, as a consequence, iv. the internal cavity on the second section of the main rectangular body of the actuator is aligned with the first aperture located inside the rectangular depression, located on said top side and near the proximal of the cartridge;

(c) placing the flat rectangular cover on the depression located on said top side of the rectangular hollow body of the cartridge;

(d) inserting the already assembled proximal part of the cartridge into the second internal cavity located inside the second end of the elongated rectangular section of the handle;

(e) inserting first and second elongated extensions of slider button into the aperture on the rectangular elongated section of the handle, thus allowing said first and second elongated extensions of the slider button to pass through: i. the aperture of the cover, ii. the first aperture located inside the rectangular depression situated on said top side of the cartridge, and iii. through the internal cavity on the second section on the main rectangular body of the actuator; wherein the first and second wedges of first and second elongated extensions of the slider button are inserted, and secured, at the broader section of said internal cavity on the second section of the actuator;

(f) inserting second spring into the cylindrical section of the plunger;

(g) inserting the rectangular section of the plunger into the first and second extensions of the direct contact with the circular opening and the front surface of the main square body of second cap;

(h) introducing the cylindrical section on the plunger, having the second spring already inserted into the hollow cavity on the distal end of the cartridge;

(i) inserting the distal section of the cartridge into the internal rectangular cavity of the head section by matching rail on the bottom side of cartridge with the elongated protruding extension on the bottom side of rectangular internal cavity on the interior of head, causing that:

i. the protruding cylindrical section, located in the internal distal flat wall of the internal rectangular cavity of the main body of the head section, be accommodated inside the rounded depression on the rear surface of the plunger; causing ii. the insertion of the first wedge of the first head locking snap on the first section of the fourth aperture on the right side of the cartridge, and the second wedge on the second head locking snap be inserted on the first section of the fifth aperture on the left side of the cartridge; and, simultaneously, iii. the pushing of the second spring in between the front surface of the plunger and the internal wall on the cartridge, by the action of the protruding cylindrical section, located in the internal distal flat wall of the internal rectangular cavity of the head main body, thus compressing the second spring, while the head section is connected to the handle; and;

wherein the head section is released from the handle section by moving the slider button backward, action that also moves the actuator backward, and the first and second wedges on the actuator's extensions also are moved from the second section of the fourth and fifth apertures of the cartridge to the first section of the same fourth and fifth apertures; said movement expulses the wedges on the first and second head locking snaps from the fourth and fifth apertures on the cartridge, thus ejecting the head section from the handle section.

2. The nail care tool as recited in claim 1, further comprising a head cap simulating the shape of the main body of the head section.

3. The nail care tool as recited in claim 1, wherein the operational material fixed to the external surface of the main body of the head section comprises a suitable material capable to absorb and retain fluids.

4. The nail care tool as recited in claim 3, wherein the main body of the head section comprises a single unit body with an external geometrical shape having a tridimensional rectangular section with curved or concave lateral sides that are extended continuously forming a top four sides pyramidal shape top section.

5. The nail care tool as recited in claim 3, wherein the main body of the head section comprises a single unit body with an external geometrical shape having a tridimensional triangular section with curved or concave lateral sides that are extended continuously forming a three sides pyramidal shape top section.

6. The nail care tool as recited in claim 3, wherein the main body of the head section comprises an external geometrical shape having a tridimensional triangular section with flat lateral sides that are extended continuously forming a three sides pyramidal shape top section.

7. The nail care tool as recited in claim 3, wherein the main body of the head section comprises a single unit body with an external geometrical shape having a tridimensional rectangular section with two curved or concave lateral sides and two flat lateral sides that are extended continuously forming a four sides pyramidal shape top section.

8. The tool as recited in claim 3, wherein the suitable material capable to absorb and retain fluids used as operational material is selected from felt, polypropylene, cotton, sponge, or any combination thereof.

9. The nail care tool as recited in claim 1, wherein the operational material fixed to the external surface of the main body of the head section comprises a suitable abrasive buffing material.

10. The nail care tool as recited in claim 9, wherein the main body of the head section comprises a single unit body with an external geometrical shape having a tridimensional rectangular section with flat sides.

11. The nail care tool as recited in claim 9, wherein the main body of the head section comprises a single unit body with an external geometrical shape having a tridimensional rectangular section with concave lateral sides.

12. The nail care tool as recited in claim 9, wherein the main body of the head section comprises a single unit body with an external geometrical shape having a tridimensional triangular section with flat lateral sides.

13. The nail care tool as recited in claim 9, wherein the main body of the head section comprises a single unit body with an external geometrical shape having a tridimensional triangular section with concave lateral sides.

14. The nail care tool as recited in claim 1, further comprising a scraper section having an elongated cylindrical body with a first pointy tip end and a second diagonal end, wherein said cylindrical body is non-permanently inserted in the first internal cavity of the cylindrical elongated section of the handle.

* * * * *